US010344583B2

(12) United States Patent
Walker et al.

(10) Patent No.: US 10,344,583 B2
(45) Date of Patent: Jul. 9, 2019

(54) ACOUSTIC HOUSING FOR TUBULARS

(71) Applicants: Katie M. Walker, Milford, NJ (US); Thomas M. Smith, Iselin, NJ (US); Henry Alan Wolf, Morris Plains, NJ (US); James S. Burns, Sugar Land, TX (US); Timothy R. Bragg, Flemington, NJ (US); Mark M. Disko, Glen Gardner, NJ (US); Yibing Zhang, Annandale, NJ (US)

(72) Inventors: Katie M. Walker, Milford, NJ (US); Thomas M. Smith, Iselin, NJ (US); Henry Alan Wolf, Morris Plains, NJ (US); James S. Burns, Sugar Land, TX (US); Timothy R. Bragg, Flemington, NJ (US); Mark M. Disko, Glen Gardner, NJ (US); Yibing Zhang, Annandale, NJ (US)

(73) Assignee: ExxonMobil Upstream Research Company, Spring, TX (US)

( * ) Notice: Subject to any disclaimer, the term of this patent is extended or adjusted under 35 U.S.C. 154(b) by 0 days.

(21) Appl. No.: 15/689,182

(22) Filed: Aug. 29, 2017

(65) Prior Publication Data

US 2018/0066510 A1 Mar. 8, 2018

Related U.S. Application Data

(60) Provisional application No. 62/428,425, filed on Nov. 30, 2016, provisional application No. 62/381,330,
(Continued)

(51) Int. Cl.
*E21B 47/16* (2006.01)
*E21B 47/01* (2012.01)
(Continued)

(52) U.S. Cl.
CPC ..... *E21B 47/011* (2013.01); *E21B 47/16* (2013.01); *E21B 47/06* (2013.01); *E21B 47/065* (2013.01);
(Continued)

(58) Field of Classification Search
CPC ..... E21B 47/011; E21B 47/16
(Continued)

(56) References Cited

U.S. PATENT DOCUMENTS 3,103,643 A 9/1963 Kalbfell ..... 340/17
3,205,477 A 9/1965 Kalbfell ..... 340/18
(Continued)

FOREIGN PATENT DOCUMENTS

CN 102733799 6/2014 ..... E21B 47/16
EP 0636763 2/1995 ..... E21B 47/12
(Continued)

OTHER PUBLICATIONS

Song, et al., U.S. Appl. No. 62/428,367, filed Nov. 30, 2016, entitled "*Dual Transducer Communications Node for Downhole Acoustic Wireless Networks and Method Employing Same.*"
(Continued)

*Primary Examiner* — Qutbuddin Ghulamali
(74) *Attorney, Agent, or Firm* — ExxonMobil Upstream Research Company—Law Department

(57) ABSTRACT

Provided is an acoustic housing including a cover including a first perimeter defining an open cover portion, the cover having a cover length, and a cover height, and a body including a second perimeter defining an open body portion, wherein either the first or second or both perimeters are chamfered, configured to receive one or more electrical components and to sealingly engage with the first chamfered perimeter, the body having a body length, a body height, and an under-surface, and the body including an engagement
(Continued)

portion projecting from the under-surface and having an engagement length, an engagement height, and an engagement surface configured to engage an outer surface of a tubular.

32 Claims, 15 Drawing Sheets

Related U.S. Application Data filed on Aug. 30, 2016, provisional application No. 62/428,367, filed on Nov. 30, 2016, provisional application No. 62/428,374, filed on Nov. 30, 2016, provisional application No. 62/433,491, filed on Dec. 13, 2016, provisional application No. 62/428,394, filed on Nov. 30, 2016.

(51) Int. Cl.
*E21B 47/06* (2012.01)
*E21B 47/10* (2012.01)
*E21B 49/00* (2006.01)
*E21B 49/08* (2006.01)
*E21B 47/09* (2012.01)

(52) U.S. Cl.
CPC ..... *E21B 47/091* (2013.01); *E21B 47/101* (2013.01); *E21B 49/00* (2013.01); *E21B 49/08* (2013.01)

(58) Field of Classification Search
USPC ..... 367/82
See application file for complete search history.

(56) References Cited

U.S. PATENT DOCUMENTS 3,512,407 A 5/1970 Zill ..... 73/152
3,637,010 A 1/1972 Malay et al. ..... 166/51
3,741,301 A 6/1973 Malay et al. ..... 166/191
3,781,783 A 12/1973 Tucker ..... 340/18
3,790,930 A 2/1974 Lamel et al. ..... 340/18
3,900,827 A 8/1975 Lamel et al. ..... 340/18
3,906,434 A 9/1975 Lamel et al. ..... 340/18
4,001,773 A 1/1977 Lamel et al. ..... 340/18
4,283,780 A 8/1981 Nardi ..... 367/82
4,298,970 A 11/1981 Shawhan et al. ..... 367/82
4,302,826 A 11/1981 Kent et al. ..... 367/82
4,314,365 A 2/1982 Petersen et al. ..... 367/82
4,884,071 A 11/1989 Howard ..... 340/854
4,962,489 A 10/1990 Medlin et al. ..... 367/32
5,128,901 A 7/1992 Drumheller ..... 367/82
5,136,613 A 8/1992 Dumestre, III ..... 375/1
5,166,908 A 11/1992 Montgomery ..... 367/165
5,182,946 A 2/1993 Boughner et al. ..... 73/151
5,234,055 A 8/1993 Cornette ..... 166/278
5,283,768 A 2/1994 Rorden ..... 367/83
5,373,481 A 12/1994 Orban et al. ..... 367/82
5,468,025 A 11/1995 Adinolfe et al. ..... 285/114
5,480,201 A 1/1996 Mercer ..... 294/67.31
5,495,230 A 2/1996 Lian ..... 340/551
5,562,240 A 10/1996 Campbell ..... 227/130
5,592,438 A 1/1997 Rorden et al. ..... 367/83
5,667,650 A 9/1997 Face et al. ..... 204/298.07
5,850,369 A 12/1998 Rorden et al. ..... 367/83
5,857,146 A 1/1999 Kido ..... 455/38.3
5,924,499 A 7/1999 Birchak et al. ..... 175/40
5,960,883 A 10/1999 Tubel et al. ..... 166/313
5,995,449 A 11/1999 Green et al. ..... 367/83
6,049,508 A 4/2000 Deflandre ..... 367/48
6,129,784 A 4/2000 Beique Jean Michel et al. ..... 340/853.2
6,125,080 A 9/2000 Sonnenschein et al. ..... 367/134
6,128,250 A 10/2000 Reid et al. ..... 367/153
6,177,882 B1 1/2001 Ringgenberg et al. .... 340/853.7
6,236,850 B1 5/2001 Desai ..... 455/343
6,239,690 B1 5/2001 Burbidge et al. ..... 340/10.33
6,300,743 B1 10/2001 Patino et al. ..... 320/106
6,320,820 B1 11/2001 Gardner et al. ..... 367/81
6,324,904 B1 12/2001 Ishikawa et al. ..... 73/152.03
6,360,769 B1 3/2002 Brisco ..... 137/268
6,394,184 B2 5/2002 Tolman et al. ..... 166/281
6,400,646 B1 6/2002 Shah et al. ..... 367/82
6,462,672 B1 10/2002 Besson ..... 340/853.2
6,543,538 B2 4/2003 Tolman et al. ..... 166/284
6,670,880 B1 12/2003 Hall et al. ..... 336/132
6,679,332 B2 1/2004 Vinegar ..... 166/373
6,695,277 B1 2/2004 Gallis ..... 241/191
6,702,019 B2 3/2004 Dusterhoft et al. ..... 166/278
6,717,501 B2 4/2004 Hall et al. ..... 336/132
6,727,827 B1 4/2004 Edwards et al. ..... 340/854.9
6,772,837 B2 8/2004 Dusterhoft et al. ..... 166/278
6,816,082 B1 11/2004 Laborde ..... 340/853.3
6,868,037 B2 3/2005 Dasgupta et al. ..... 367/54
6,880,634 B2 4/2005 Gardner et al. ..... 166/250.01
6,883,608 B2 4/2005 Parlar et al. ..... 166/278
6,899,178 B2 5/2005 Tubel ..... 166/313
6,909,667 B2 6/2005 Shah et al. ..... 367/83
6,912,177 B2 6/2005 Smith ..... 367/82
6,920,085 B2 7/2005 Finke et al. ..... 367/83
6,930,616 B2 8/2005 Tang et al. ..... 340/854.4
6,940,420 B2 9/2005 Jenkins ..... 340/855.6
69,411,397 9/2005 Chan et al. ..... 340/10.4
6,953,093 B2 10/2005 Ross et al. ..... 166/381
6,956,791 B2 * 10/2005 Dopf ..... E21B 47/16 181/102
6,980,929 B2 * 12/2005 Aronstam ..... G06Q 10/06 702/188
6,987,463 B2 1/2006 Beique et al. ..... 340/856.3
7,006,918 B2 2/2006 Economides et al. ..... 702/1
7,011,157 B2 3/2006 Costley et al. ..... 166/311
7,036,601 B2 5/2006 Berg et al. ..... 166/385
7,051,812 B2 5/2006 McKee et al. ..... 166/305.1
7,064,676 B2 6/2006 Hall et al. ..... 350/853.1
7,082,993 B2 8/2006 Ayoub et al. ..... 166/250.1
7,090,020 B2 8/2006 Hill et al. ..... 166/373
7,140,434 B2 11/2006 Chouzenoux et al. .. 166/250.11
7,219,762 B2 5/2007 James et al. ..... 181/105
7,224,288 B2 5/2007 Hall et al. ..... 340/853.7
7,228,902 B2 6/2007 Oppelt ..... 166/250.02
7,249,636 B2 * 7/2007 Ohmer ..... E21B 17/003 166/383
7,252,152 B2 8/2007 LoGiudice et al. ..... 166/386
7,257,050 B2 8/2007 Stewart et al. ..... 367/82
7,261,154 B2 8/2007 Hall et al. ..... 166/242.2
7,261,162 B2 8/2007 Deans et al. ..... 166/336
7,275,597 B2 10/2007 Hall et al. ..... 166/297
7,277,026 B2 10/2007 Hall et al. ..... 340/854.8
RE40,032 E 1/2008 van Bokhorst et al. ... 455/343.2
7,317,990 B2 1/2008 Sinha et al. ..... 702/6
7,321,788 B2 1/2008 Addy et al. ..... 455/574
7,322,416 B2 1/2008 Burris, II et al. ..... 166/308.1
7,325,605 B2 2/2008 Fripp et al. ..... 166/250.01
7,339,494 B2 3/2008 Shah et al. ..... 340/855.7
7,348,893 B2 3/2008 Huang et al. ..... 340/854.8
7,385,523 B2 6/2008 Thomeer et al. ..... 340/854.8
7,387,165 B2 6/2008 Lopez de Cardenas et al. ..... 166/313
7,411,517 B2 * 8/2008 Flanagan ..... G01V 11/002 175/40
7,477,160 B2 1/2009 Lemenager et al. ..... 166/308.1
7,516,792 B2 4/2009 Lonnes et al. ..... 166/308.1
7,551,057 B2 6/2009 King et al. ..... 340/5.72
7,590,029 B2 9/2009 Tingley ..... 367/82
7,595,737 B2 9/2009 Fink et al. ..... 340/854.4
7,602,668 B2 10/2009 Liang et al. ..... 367/25
7,649,473 B2 1/2010 Johnson et al. ..... 340/853.1
7,750,808 B2 7/2010 Masino et al. ..... 340/572.1
7,775,279 B2 8/2010 Marya et al. ..... 166/297
7,787,327 B2 8/2010 Tang et al. ..... 367/27
7,819,188 B2 10/2010 Auzerais et al. ..... 155/250
7,828,079 B2 11/2010 Oothoudt ..... 175/20
7,831,283 B2 11/2010 Ogushi et al. ..... 455/574

(56) References Cited

U.S. PATENT DOCUMENTS 7,913,773 B2 3/2011 Li et al. ..... 175/40
7,952,487 B2 5/2011 Montebovi ..... 340/636.1
7,994,932 B2 8/2011 Huang et al. ..... 340/854.3
8,004,421 B2 8/2011 Clark ..... 340/854.4
8,044,821 B2 10/2011 Mehta ..... 340/855.7
8,049,506 B2 11/2011 Lazarev ..... 324/333
8,115,651 B2 2/2012 Camwell et al. ..... 340/853.2
8,117,907 B2 2/2012 Han et al. ..... 73/152.58
8,157,008 B2 4/2012 Lilley ..... 166/253.1
8,162,050 B2 4/2012 Roddy et al. ..... 166/253.1
8,220,542 B2 7/2012 Whitsitt et al. ..... 166/278
8,237,585 B2 8/2012 Zimmerman ..... 340/854.6
8,242,928 B2 8/2012 Prammer ..... 340/853.7
8,276,674 B2 10/2012 Lopez De Cardenas et al. ..... 166/373
8,284,075 B2 10/2012 Fincher et al. ..... 340/854.4
8,284,947 B2 10/2012 Giesbrecht et al. ..... 381/66
8,316,936 B2 11/2012 Roddy et al. ..... 166/253.1
8,330,617 B2 12/2012 Chen et al. ..... 340/854.6
8,347,982 B2 1/2013 Hannegan et al. ..... 175/5
8,358,220 B2 1/2013 Savage ..... 340/853.1
8,376,065 B2 2/2013 Teodorescu et al. ..... 175/40
8,381,822 B2 2/2013 Hales et al. ..... 166/377
8,388,899 B2 3/2013 Mitani et al. ..... 422/179
8,411,530 B2 4/2013 Slocum et al. ..... 367/90
8,434,354 B2 5/2013 Crow et al. ..... 73/152.04
8,494,070 B2 7/2013 Luo et al. ..... 375/262
8,496,055 B2 7/2013 Mootoo et al. ..... 166/278
8,539,890 B2 9/2013 Tripp et al. ..... 109/25
8,544,564 B2 10/2013 Moore et al. ..... 175/50
8,552,597 B2 10/2013 Song et al. ..... 307/149
8,556,302 B2 10/2013 Dole ..... 285/367
8,559,272 B2 10/2013 Wang
8,596,359 B2 12/2013 Grigsby et al. ..... 166/278
8,605,548 B2 12/2013 Froelich ..... 367/82
8,607,864 B2 12/2013 McLeod et al. ..... 166/250.1
8,664,958 B2 3/2014 Simon ..... 324/338
8,672,875 B2 3/2014 Vanderveen et al. ..... 604/67
8,675,779 B2 3/2014 Zeppetelle et al. ..... 375/340
8,683,859 B2 * 4/2014 Godager ..... E21B 41/0085 73/152.54
8,689,621 B2 * 4/2014 Godager ..... E21B 41/0085 73/152.54
8,701,480 B2 4/2014 Eriksen ..... 73/152.51
8,750,789 B2 6/2014 Baldemair et al. ..... 455/11.1
8,787,840 B2 7/2014 Srinivasan et al. ..... 455/69
8,805,632 B2 8/2014 Coman et al. ..... 702/89
8,826,980 B2 * 9/2014 Neer ..... E21B 34/14 166/255.1
8,833,469 B2 * 9/2014 Purkis ..... E21B 34/066 166/373
8,893,784 B2 11/2014 Abad ..... E21B 43/26
8,910,716 B2 12/2014 Newton et al. ..... 166/373
8,994,550 B2 3/2015 Millot et al. ..... E21B 47/16
8,995,837 B2 3/2015 Mizuguchi et al. ... H04B 10/27
9,062,508 B2 6/2015 Huval et al. ..... E21B 47/122
9,075,155 B2 7/2015 Luscombe et al. .... G01V 1/226
9,078,055 B2 7/2015 Nguyen et al. ..... H04R 5/00
9,091,153 B2 7/2015 Yang et al. ..... E21B 47/12
9,133,705 B2 9/2015 Angeles Boza et al. ..... E21B 47/12
9,140,097 B2 9/2015 Themig et al. ..... E21B 34/12
9,144,894 B2 9/2015 Barnett et al. ..... B25B 17/00
9,206,645 B2 12/2015 HallundbæK ..... E21B 7/04
9,279,301 B2 3/2016 Lovorn et al. ..... E21B 21/103
9,284,819 B2 3/2016 Tolman et al. ..... E21B 41/00
9,284,834 B2 3/2016 Alteirac et al. ..... E21B 47/12
9,310,510 B2 4/2016 Godager ..... G01V 3/38
9,333,350 B2 5/2016 Rise et al. ..... A61N 1/36082
9,334,696 B2 5/2016 Hay ..... E21B 47/12
9,359,841 B2 6/2016 Hall ..... E21B 23/00
9,363,605 B2 6/2016 Goodman et al. ..... H04R 17/00
9,376,908 B2 6/2016 Ludwig et al. ..... E21B 47/01
9,441,470 B2 9/2016 Guerrero et al. ..... E21B 43/14
9,515,748 B2 12/2016 Jeong ..... G10L 25/90
9,557,434 B2 1/2017 Keller ..... G01V 1/52
9,617,829 B2 4/2017 Dale et al. ..... E21B 41/00
9,617,850 B2 4/2017 Fripp et al. ..... E21B 47/18
9,631,485 B2 4/2017 Keller et al. ..... E21B 47/16
9,657,564 B2 5/2017 Stolpman ..... E21B 47/16
9,664,037 B2 5/2017 Logan et al. ..... E21B 47/122
9,670,773 B2 6/2017 Croux ..... E21B 47/16
9,683,434 B2 6/2017 Machocki ..... E21B 44/00
9,686,021 B2 6/2017 Merino ..... E21B 47/16
9,715,031 B2 7/2017 Contant et al. ..... E21B 47/122
9,721,448 B2 8/2017 Wu et al. ..... G08B 21/20
9,759,062 B2 9/2017 Deffenbaugh et al. ..... E21B 47/16
9,816,373 B2 11/2017 Howell et al. ..... E21B 47/16
9,822,634 B2 11/2017 Gao ..... E21B 47/16
9,863,222 B2 1/2018 Morrow et al. ..... E21B 43/122
9,879,525 B2 1/2018 Morrow et al. ..... E21B 47/12
9,945,204 B2 4/2018 Ross et al. ..... E21B 33/127
9,963,955 B2 5/2018 Tolman et al. ..... E21B 43/119
10,100,635 B2 10/2018 Keller et al. ..... E21B 47/18
10,103,846 B2 10/2018 Van Zelm et al. ..... E21B 47/12
10,132,149 B2 11/2018 Morrow et al. ..... E21B 43/267
10,145,228 B2 12/2018 Yarus et al. ..... E21B 44/00
10,167,716 B2 1/2019 Clawson et al. ..... E21B 47/16
10,167,717 B2 1/2019 Deffenbaugh et al. ..... E21B 47/14
10,190,410 B2 1/2019 Clawson et al. ..... E21B 47/14
10,196,862 B2 2/2019 Li-Leger et al. ..... E21B 17/02
2002/0180613 A1 12/2002 Shi et al. ..... E21B 47/18
2003/0056953 A1 3/2003 Tumlin et al. ..... 166/298
2003/0117896 A1 6/2003 Sakuma et al. ..... 367/81
2004/0020063 A1 2/2004 Lewis et al. ..... 33/313
2004/0200613 A1 10/2004 Fripp et al. ..... 166/250.01
2004/0239521 A1 12/2004 Zierolf ..... 340/854.1
2005/0269083 A1 12/2005 Burris, II et al. ..... 166/255.2
2005/0284659 A1 12/2005 Hall et al. ..... 175/27
2006/0033638 A1 2/2006 Hall et al. ..... 340/854.6
2006/0041795 A1 2/2006 Gabelmann et al. ..... 714/699
2006/0090893 A1 5/2006 Sheffield ..... 166/250.15
2007/0139217 A1 6/2007 Beique et al. ..... 340/856.3
2007/0146351 A1 6/2007 Katsurahira et al. ..... 345/179
2007/0156359 A1 7/2007 Varsamis et al. ..... 702/69
2007/0219758 A1 9/2007 Bloomfield ..... 702/190
2007/0272411 A1 11/2007 Lopez De Cardenas et al. ..... 166/305.1
2008/0030365 A1 2/2008 Fripp et al. ..... E21B 47/16
2008/0110644 A1 5/2008 Howell et al. ..... 166/387
2008/0185144 A1 8/2008 Lovell ..... 166/250.17
2008/0304360 A1 12/2008 Mozer ..... 367/117
2009/0003133 A1 1/2009 Dalton et al. ..... 367/82
2009/0030614 A1 1/2009 Carnegie et al. ..... 702/6
2009/0034368 A1 2/2009 Johnson ..... 367/83
2009/0045974 A1 2/2009 Patel ..... 340/854.6
2009/0080291 A1 3/2009 Tubel et al. ..... 367/81
2009/0166031 A1 7/2009 Hernandez ..... 166/250.01
2010/0013663 A1 1/2010 Cavender et al. ..... 340/854.3
2010/0089141 A1 4/2010 Rioufol et al. ..... 73/152.28
2010/0133004 A1 6/2010 Burleson et al. ..... 175/2
2010/0182161 A1 7/2010 Robbins et al. ..... 340/853.7
2010/0212891 A1 8/2010 Stewart et al. ..... 166/250.12
2011/0061862 A1 3/2011 Loretz et al. ..... 166/250.11
2011/0066378 A1 3/2011 Lerche et al. ..... 702/6
2011/0168403 A1 7/2011 Patel ..... 166/373
2011/0188345 A1 8/2011 Wang ..... 367/34
2011/0297376 A1 12/2011 Holderman et al. ..... 166/278
2011/0297673 A1 12/2011 Zbat et al. ..... 219/756
2011/0301439 A1 12/2011 Albert et al. ..... 600/301
2011/0315377 A1 12/2011 Rioufol ..... 166/250.17
2012/0043079 A1 2/2012 Wassouf et al. ..... 166/250
2012/0126992 A1 5/2012 Rodney et al. ..... 340/850
2012/0152562 A1 6/2012 Newton et al. ..... 166/369
2012/0179377 A1 7/2012 Lie ..... 702/6
2013/0000981 A1 1/2013 Grimmer et al. ..... 175/45
2013/0003503 A1 1/2013 L'Her et al. ..... 367/106
2013/0106615 A1 5/2013 Prammer ..... 340/854.6
2013/0138254 A1 5/2013 Seals ..... 700/282
2013/0192823 A1 8/2013 Barrilleaux et al. ..... 166/250.01
2013/0248172 A1 9/2013 Angeles Boza et al.

(56) References Cited

U.S. PATENT DOCUMENTS

| | | | | |
|---|---|---|---|---|
| 2013/0278432 | A1 | 10/2013 | Shashoua et al. | 340/853.7 |
| 2013/0319102 | A1 | 12/2013 | Ringgenberg et al. | 73/152.28 |
| 2014/0060840 | A1 | 3/2014 | Hartshorne et al. | 166/300 |
| 2014/0062715 | A1 | 3/2014 | Clark | 340/853.2 |
| 2014/0102708 | A1 | 4/2014 | Purkis et al. | 166/308.1 |
| 2014/0133276 | A1 | 5/2014 | Volker et al. | 367/82 |
| 2014/0152659 | A1 | 6/2014 | Davidson et al. | 345/420 |
| 2014/0153368 | A1 | 6/2014 | Bar-Cohen et al. | 367/81 |
| 2014/0166266 | A1 | 6/2014 | Read | 166/250.01 |
| 2014/0170025 | A1 | 6/2014 | Weiner et al. | 422/82.01 |
| 2014/0266769 | A1 | 9/2014 | Van Zelm | 340/854.3 |
| 2014/0327552 | A1 | 11/2014 | Filas | 340/854.6 |
| 2014/0352955 | A1* | 12/2014 | Tubel | E21B 43/12 166/250.15 |
| 2015/0003202 | A1 | 1/2015 | Palmer et al. | 367/82 |
| 2015/0009040 | A1* | 1/2015 | Bowles | E21B 47/122 340/854.6 |
| 2015/0027687 | A1 | 1/2015 | Tubel | 166/72 |
| 2015/0041124 | A1 | 2/2015 | Rodriguez | 166/255.1 |
| 2015/0041137 | A1 | 2/2015 | Rodriguez | 166/301 |
| 2015/0152727 | A1 | 6/2015 | Fripp et al. | E21B 47/14 |
| 2015/0159481 | A1 | 6/2015 | Mebarkia et al. | E21B 47/065 |
| 2015/0167425 | A1 | 6/2015 | Hammer et al. | E21B 34/06 |
| 2015/0176370 | A1 | 6/2015 | Greening et al. | E21B 41/00 |
| 2015/0292319 | A1 | 10/2015 | Disko et al. | E21B 47/16 |
| 2015/0292320 | A1 | 10/2015 | Lynk et al. | E21B 47/16 |
| 2015/0300159 | A1 | 10/2015 | Stiles et al. | E21B 47/19 |
| 2015/0330200 | A1 | 11/2015 | Richard et al. | E21B 44/00 |
| 2015/0337642 | A1 | 11/2015 | Spacek | E21B 44/005 |
| 2015/0354351 | A1 | 12/2015 | Morrow et al. | E21B 47/16 |
| 2015/0377016 | A1 | 12/2015 | Ahmad | E21B 47/122 |
| 2016/0010446 | A1 | 1/2016 | Logan et al. | E21B 47/122 |
| 2016/0047230 | A1 | 2/2016 | Livescu et al. | E21B 47/10 |
| 2016/0047233 | A1 | 2/2016 | Butner et al. | E21B 47/12 |
| 2016/0076363 | A1 | 3/2016 | Morrow et al. | E21B 47/12 |
| 2016/0109606 | A1 | 4/2016 | Market et al. | G01V 1/50 |
| 2016/0215612 | A1 | 7/2016 | Morrow | E21B 47/122 |
| 2017/0138185 | A1 | 5/2017 | Saed et al. | E21B 47/16 |
| 2017/0145811 | A1 | 5/2017 | Robison et al. | E21B 47/0007 |
| 2017/0152741 | A1 | 6/2017 | Park et al. | E21B 47/123 |
| 2017/0167249 | A1 | 6/2017 | Lee et al. | E21B 47/14 |
| 2017/0204719 | A1 | 7/2017 | Babakhani | E21B 47/0005 |
| 2017/0254183 | A1 | 9/2017 | Vasques et al. | E21B 47/16 |
| 2017/0293044 | A1 | 10/2017 | Gilstrap et al. | G01V 1/50 |
| 2017/0314386 | A1 | 11/2017 | Orban et al. | E21B 47/091 |
| 2018/0010449 | A1 | 1/2018 | Roberson et al. | E21B 47/16 |
| 2018/0058191 | A1 | 3/2018 | Romer et al. | E21B 47/0007 |
| 2018/0058198 | A1 | 3/2018 | Ertas et al. | E21B 47/12 |
| 2018/0058202 | A1 | 3/2018 | Disko et al. | E21B 47/14 |
| 2018/0058203 | A1 | 3/2018 | Clawson et al. | E21B 47/14 |
| 2018/0058204 | A1 | 3/2018 | Clawson et al. | E21B 47/14 |
| 2018/0058205 | A1 | 3/2018 | Clawson et al. | E21B 47/14 |
| 2018/0058206 | A1 | 3/2018 | Zhang et al. | E21B 47/16 |
| 2018/0058207 | A1 | 3/2018 | Song et al. | E21B 47/16 |
| 2018/0058209 | A1 | 3/2018 | Song et al. | E21B 47/16 |
| 2018/0066490 | A1 | 3/2018 | Kjos | E21B 33/035 |
| 2018/0066510 | A1* | 3/2018 | Walker | E21B 47/011 |

FOREIGN PATENT DOCUMENTS

| | | | | |
|---|---|---|---|---|
| EP | 1409839 | | 4/2005 | E21B 43/1185 |
| EP | 2677698 | | 12/2013 | H04L 12/28 |
| WO | WO2002/027139 | | 4/2002 | E21B 43/12 |
| WO | WO20110/074766 | | 7/2010 | A41C 1/14 |
| WO | WO2013/079928 | | 6/2013 | E21B 47/12 |
| WO | WO 2013/079928 | A2 | 6/2013 | |
| WO | WO 2013/112273 | A2 | 8/2013 | |
| WO | WO 2014/018010 | A1 | 1/2014 | |
| WO | WO20141018010 | | 1/2014 | E21B 47/12 |
| WO | WO2014/049360 | | 4/2014 | E21B 47/12 |
| WO | WO 2014/049360 | A2 | 4/2014 | |
| WO | WO2014/100271 | | 6/2014 | E21B 47/12 |
| WO | WO2014/134741 | | 9/2014 | E21B 47/13 |
| WO | WO 2014/134741 | A1 | 9/2014 | |
| WO | WO2015/117060 | | 8/2015 | E21B 47/12 |

OTHER PUBLICATIONS

U.S. Appl. No. 15/666,334, dated Aug. 1, 2017, Walker, Katie M. et al.

U.S. Appl. No. 16/139,373, dated Sep. 24, 2018, Yi, Xiaohua et al.

U.S. Appl. No. 16/139,384, dated Oct. 13, 2017, Disko, Mark M. et al.

U.S. Appl. No. 16/139,394, dated Oct. 13, 2017, Song, Limin et al.

U.S. Appl. No. 16/139,403, dated Oct. 13, 2017, Song, Limin et al.

U.S. Appl. No. 16/139,414, dated Oct. 13, 2017, Zhang, Yibing et al.

U.S. Appl. No. 16/139,421, dated Oct. 13, 2017, Song, Limin et al.

U.S. Appl. No. 16/139,427, dated Oct. 13, 2017, Disko, Mark M. et al.

U.S. Appl. No. 16/175,418, dated Oct. 30, 2018, Kent, David K. et al.

U.S. Appl. No. 62/588,067, dated Nov. 17, 2017, Song, Limin et al.

U.S. Appl. No. 62/588,080, dated Nov. 17, 2017, Kinn, Timothy F. et al.

U.S. Appl. No. 62/588,103, dated Nov. 17, 2019, Yi, Xiaohua et al.

Arroyo, Javier et al. (2009) "Forecasting Histogram Time Series with K-Nearest Neighbours Methods," *International Journal of Forecasting*, v.25, pp. 192-207.

Arroyo, Javier et al. (2011) "Smoothing Methods for Histogram-Valued Time Seriers: An Application to Value-at-Risk," *Univ. Of California, Dept. Of Economics*, www.wileyonlinelibrary.com., Mar. 8, 2011, 28 pages.

Arroyo, Javier et al. (2011) "Forecasting with Interval and Histogram Data Some Financial Applications," *Univ. Of California, Dept. Of Economics*, 46 pages.

Emerson Process Management (2011), "Roxar downhole Wireless PT sensor system," www.roxar.com, or downhole@roxar.com, 2 pgs.

Gonzalez-Rivera, Gloria et al. (2012) "Time Series Modeling of Histogram-Valued Data: The Daily Histogram Time Series of S&P500 Intradaily Returns," *International Journal of Forecasting*, v.28, 36 pgs.

Gutierrez-Estevez, M. A. et al. (2013) "Acoustic Boardband Communications Over Deep Drill Strings using Adaptive OFDM", *IEEE Wireless Comm. & Networking Conf.*, pages 4089-4094.

Qu, X. et al. (2011) "Reconstruction fo Self-Sparse 20 NMR Spectra From undersampled Data In The Indirect Dimension", pp. 8888-8909.

U.S. Department of Defense (1999) "Interoperability and Performance Standards for Medium and High Frequency Radio Systems," *MIL-STD-188-141B*, Mar. 1, 1999, 584 pages.

* cited by examiner

ACOUSTIC HOUSING FOR TUBULARS

CROSS REFERENCE TO RELATED APPLICATIONS

This application claims the benefit of U.S. Provisional Application Ser. No. 62/428,425, filed Nov. 30, 2016, entitled "Acoustic Housing for Tubulars," U.S. Provisional Application Ser. No. 62/381,330 filed Aug. 30, 2016, entitled "Communication Networks, Relay Nodes for Communication Networks, and Methods of Transmitting Data Among a Plurality of Relay Nodes," U.S. Provisional Application Ser. No. 62/428,367, filed Nov. 30, 2016, entitled "Dual Transducer Communications Node for Downhole Acoustic Wireless Networks and Method Employing Same," U.S. Provisional Application Ser. No. 62/428,374, filed Nov. 30, 2016, entitled "Hybrid Downhole Acoustic Wireless Network," U.S. Provisional Application Ser. No. 62/433,491, filed Dec. 13, 2016 entitled "Methods of Acoustically Communicating And Wells That Utilize The Methods," and U.S. Provisional Application Ser. No. 62/428,394, filed Nov. 30, 2016, entitled "Downhole Multiphase Flow Sensing Methods," the disclosures of which are incorporated herein by reference in their entireties. This application is related to U.S. Non-provisional application Ser. No. 15/666,334, filed Aug. 1, 2017, entitled "Acoustic Housing for Tubulars."

FIELD

The present disclosure relates generally to device housings, methods, and systems for installing electronics packages on a downhole tubular.

BACKGROUND

Device housings for installing electronics packages, including for example, sensors and telemetry devices, on a downhole tubular, are subject to harsh environmental conditions including for example, extreme heat, high pressure, humidity, and varying soil conditions. Standard device housings present continued reliability problems, are large and expensive, and have a design that prohibits the reliable installation of electronic and acoustic assemblies inside the housing and makes it difficult to maintain an appropriate seal from the external environment.

Device housings, methods, and systems for installing electronics packages on a downhole tubular to improve reliability, performance, and cost effectiveness are described below.

SUMMARY

The presently described subject matter is directed to an acoustic housing for installing electronics packages, including for example, sensors and telemetry devices, on a downhole tubular, where the acoustic housing can include an engagement surface that is configured to engage an outer surface of the tubular. The engagement surface can comprise a V-configuration engagement surface formed by an obtuse angle, the V-configuration engagement surface can be provided along an engagement length of the engagement surface. The V-configuration engagement surface provides strong acoustic coupling between the acoustic housing and a tubular (and thus strong telemetry signals both on send and receive sides). The presently described V-configuration provides an acoustic housing that can be used with a wide range of tubulars of varying diameters. In addition, the V-configuration allows some accommodation to local variations in the degree of tubular curvature. The presently described acoustic housing comprising a V-configuration engagement surface avoids the need for re-machining a housing or making multiple housing designs in order to fit differing tubular diameters and/or variations in the degree of curvature, while providing strong coupling of vibrations between the V-configuration housing and a particular tubular.

In another aspect, the presently described acoustic housing can include an engagement portion having an engagement surface to contact, for example, a tubular, including for example, an external body such as a casing or pipe, the engagement portion can comprise a flat or substantially flat engagement surface, a radiused engagement surface, or a V-configuration engagement surface formed by an obtuse angle such that the engagement portion has a V-shaped cross-section. The radiused engagement surface or the V-configuration engagement surface can be provided along the engagement length. A radiused engagement surface provides acoustic coupling for a single tubular diameter, while a V-configuration surface enables strong acoustic coupling (performance) over a wide range of tubular diameters.

In yet another aspect, the presently described acoustic housing can be attached to an outer surface of a tubular, where when the housing is attached to the outer surface of the tubular, at least a portion of the engagement surface is in contact with the outer surface of the tubular.

The presently described attachment and clamping scheme maximizes the beneficial acoustical contact between the engagement surface and the tubular. The clamping scheme is also configured to provide ruggedized mechanical durability in the downhole environment.

In another aspect, provided is a communication node, including a sealed acoustic housing as presently described herein; electrical components including for example, an independent power source residing within the acoustic housing, one or more electro-acoustic transducers to provide telemetry, and associated transmitter, receiver, or transceiver residing within the acoustic housing and configured to receive and relay information using acoustic tones, and a circuit board residing within the acoustic housing.

According to the presently described subject matter, piezoelectric wafers or other piezoelectric elements are used to receive and transmit acoustic signals. In another aspect, multiple stacks of piezoelectric crystals or magnetostrictive devices can be used. Signals are created by applying electrical signals of an appropriate frequency across one or more piezoelectric crystals, causing them to vibrate at a rate corresponding to the frequency of the desired acoustic signal. Each acoustic signal represents a packet of data comprised of a collection of separate tones. Piezoelectric crystal can be used as a transducer to either convert mechanical or acoustical signals to electric signals, or vice versa.

The presently described subject matter is directed to an acoustic housing, comprising a cover comprising a first chamfered perimeter defining an open cover portion, and having a cover length and a cover height; and a body comprising a second chamfered perimeter defining an open body portion configured to receive one or more electrical components and to sealingly engage with the first chamfered perimeter, the body having a body length, a body height, and an under-surface, and an engagement portion projecting from the under-surface and having an engagement length, an engagement height, and an engagement surface configured to engage an outer surface of a tubular. It is recommended that to ensure the housing cover and body can be pressure-tight and maintain a hermetic seal is to have at least one chamfered perimeter, either on the housing cover or body, while the other mating surface is either unchamfered or chamfered so as to provide sealing-redundancy or robustness in conjunction with the mating chamfered piece in the chamfering design.

The presently described subject matter is further directed to any acoustic housing as described herein, where the body and the engagement portion are integral, for example, formed, e.g., machined, from a single piece of material. Alternatively, the body and the engagement portion may be produced separately, and later joined, for example, by welding.

The presently described subject matter is yet further directed to any acoustic housing as described herein, wherein the engagement portion is continuous or discontinuous.

The presently described subject matter is directed to any acoustic housing as described herein, wherein the engagement portion is a continuous engagement portion.

The presently described subject matter is further directed to any acoustic housing as described herein, wherein the engagement portion is a discontinuous engagement portion.

The presently described subject matter is also directed to any acoustic housing as described herein, wherein the continuous engagement portion comprises a single continuous engagement portion having an engagement length that is substantially equal to or less than the body length.

The presently described subject matter is directed to any acoustic housing as described herein, wherein the discontinuous engagement portion comprises at least two non-contiguous segments, for example, two, three, four, or five non-contiguous segments.

The presently described subject matter is also directed to an acoustic housing where the engagement portion is continuous or discontinuous. For example, the engagement portion can be a continuous engagement portion. The engagement portion can be a discontinuous engagement portion. A continuous engagement portion can comprise or consist of a single continuous engagement portion having an engagement length that is substantially equal to the body length. A discontinuous engagement portion can comprise or consist of at least two non-contiguous segments, at least three non-contiguous segments, from 2 to 5 non-contiguous segments, from 3 to 5 non-contiguous segments, from 2 to 4 non-contiguous segments, or can comprise or consist of three (3) non-contiguous segments.

The presently described subject matter is further directed to any acoustic housing as described herein, wherein the engagement portion comprises a V-configuration engagement surface comprising an obtuse angle, defining a lengthwise central groove traversing the engagement length.

The presently described subject matter is yet further directed to any acoustic housing as described herein, wherein the engagement portion has a V-shaped cross-section.

The presently described subject matter is directed to any acoustic housing as described herein, wherein the V-configuration can comprise an obtuse angle, of for example, >90° and <180°, ≥100° and ≤175°, ≥110° and ≤175°, ≥120° and ≤175°, ≥130° and ≤175°, ≥140° and ≤175°, ≥150° and ≤175°, ≥160° and ≤175°, ≥165° and ≤175°, ≥170° and ≤175°, ≥165° and ≤170°, or ≥172° and ≤179°.

The presently described subject matter is further directed to any acoustic housing as described herein, wherein the engagement surface comprises a radiused engagement surface where the radiused engagement surface is designed to correspond to a specific tube diameter.

The presently described subject matter is yet further directed to any acoustic housing as described herein, wherein the first chamfered perimeter and/or the second chamfered perimeter are each configured such that upon engagement, a perimeter space is defined therebetween. For example, one or both of the first and second chamfered perimeters can be configured such that the perimeter space traverses the entire perimeter or a portion of the perimeter.

The presently described subject matter is directed to any acoustic housing as described herein, further comprising one or more electrical components disposed in the open body portion.

The presently described subject matter is also directed to any acoustic housing as described herein, wherein the one or more electrical components comprise an independent power source, an electro-acoustic transducer, and a transceiver for receiving and transmitting acoustic waves.

The presently described subject matter is directed to any acoustic housing as described herein, wherein the electro-acoustic transducer and associated transceiver are configured to receive and re-transmit the acoustic waves, thereby providing communications telemetry, wherein each of the acoustic waves represents a packet of information comprising a plurality of separate tones.

The presently described subject matter is directed to any acoustic housing as described herein, further comprising a sealing material provided at least at the first chamfered perimeter and/or the second chamfered perimeter to seal the cover and the body together.

The presently described subject matter is further directed to any acoustic housing as described herein, wherein the sealing material is a chemical bonding material. The chemical bonding material can comprise an epoxy.

The presently described subject matter is directed to any acoustic housing as described herein, further comprising a malleable material provided in the lengthwise central groove.

The presently described subject matter is further directed to any acoustic housing as described herein, wherein the malleable material is configured to bridge at least a portion of a gap between the V-configuration engagement surface and the outer surface of the tubular when the acoustic housing is attached to the outer surface of the tubular.

The presently described subject matter is yet further directed to any acoustic housing as described herein, wherein the malleable material comprises a malleable metal and/or metal alloy.

The presently described subject matter is further directed to any acoustic housing as described herein, wherein the malleable metal and/or metal alloy comprises copper. Other examples of malleable metals include but are not limited to silver, gold, steel, aluminum, and lead.

The presently described subject matter is further directed to any acoustic housing as described herein, wherein the malleable metal and/or metal alloy comprises a wire having a diameter.

The presently described subject matter is directed to any acoustic housing as described herein, wherein the wire having a diameter is fixed in the lengthwise central groove.

The presently described subject matter is also directed to any acoustic housing as described herein, wherein the wire is adhered in the lengthwise central groove via an adhesive. The adhesive can be a strong couplant-adhesive, such as an epoxy. Alternatively, acoustic couplant may be used to enable energy transfer from the housing, through the wire, to the tubular.

The presently described subject matter is directed to any acoustic housing as described herein, wherein the diameter of a wire is sufficient to bridge the gap between the engagement surface and the surface of the tubular.

The presently described subject matter is further directed to any acoustic housing as described herein, wherein the diameter of the wire is selected sufficient to bridge the gap, where in some instances, the greater the obtuse angle, the larger the tubular diameter, and the smaller the diameter of the wire; conversely, the smaller the obtuse angle, the smaller the tubular diameter, and the larger the diameter of the wire.

The presently described subject matter is further directed to any acoustic housing as described herein, wherein the diameter of the wire is from about 0.002 cm to about 0.05 cm.

The presently described subject matter is further directed to any acoustic housing as described herein, where the acoustic housing is fabricated from steel.

The presently described subject matter is further directed to any acoustic housing as described herein, configured to withstand a pressure of up to and including 15,000 psi.

The presently described subject matter is directed to any acoustic housing as described herein, further comprising a first lengthwise tab extending from a first linear end of the cover adjacent the open cover portion, and a second lengthwise tab extending from an opposing second linear end of the cover adjacent the open cover portion, each of the first and second lengthwise tabs having a tab length, a tab height less than the cover height, a terminal end, and a first tab surface and an opposing second tab surface.

The presently described subject matter is directed to any acoustic housing as described herein, further comprising a shoulder defined by projection of the engagement surface beyond the second tab surface, and the shoulder provides clearance between the second tab surface and the outer surface of the tubular.

The presently described subject matter is further directed to any acoustic housing as described herein, wherein each of the first lengthwise tab and the second lengthwise tab further comprise a terminal projection extending from the first tab surface at the terminal end.

The presently described subject matter is also directed to any acoustic housing as described herein, wherein the second tab surface comprises a V-configuration tab surface or a radiused tab surface provided along the lower surface of the tab length. The V-configuration tab surface can be at an obtuse angle >90° and <180°.

The presently described subject matter is also directed to any acoustic housing as described herein, wherein the second tab surface comprises a radiused tab surface provided along the tab length.

The presently described subject matter is directed to any acoustic housing as described herein, further comprising at least one clamp for circumferentially attaching the acoustic housing to an outer surface of a tubular.

The presently described subject matter is directed to any acoustic housing as described herein, wherein at least one clamp comprises a first arcuate section; a second arcuate section; a hinge for pivotally connecting the first and second arcuate sections; and a fastening mechanism for securing the first and second arcuate sections around an outer surface of a tubular.

The presently described subject matter is directed to any acoustic housing as described herein, wherein the clamp is provided over a first tab surface between the terminal projection and a linear end of the body such that when the acoustic housing is attached to the outer wall of a tubular, the tab is disposed between an inner surface of the clamp and the outer surface of the tubular.

The presently described subject matter is further directed to any acoustic housing as described herein, comprising a cover comprising a first perimeter defining an open cover portion, the cover having a cover length and a cover height; and a body comprising a second perimeter defining an open body portion configured to receive one or more electrical components and to sealingly engage with the first perimeter, the body having a body length, a body height, and an under-surface, and an engagement portion projecting from the under-surface and having an engagement length, an engagement height, and an engagement surface configured to engage an outer surface of a tubular, the engagement portion comprising a V-configuration engagement surface comprising an obtuse angle, defining a lengthwise central groove traversing the engagement length. The minimum requirement to ensure the housing cover and body can be sealed is to have at least one chamfered perimeter; either on the housing cover or body. In some designs, it may be feasible to provide a chamfer on both the housing and the body to provide a redundant seal.

The presently described subject matter is directed to any acoustic housing as described herein, comprising a cover comprising a first chamfered perimeter defining an open cover portion, the cover having a cover length and a cover height; and a body comprising a second chamfered perimeter defining an open body portion configured to receive one or more electrical components and to sealingly engage with the first chamfered perimeter, the first chamfered perimeter and the second chamfered perimeter are each configured such that upon engagement, a perimeter space is defined therebetween, the body having a body length, a body height, and an under-surface, and an engagement portion projecting from the under-surface and having an engagement length, the engagement portion comprising a V-configuration engagement surface configured to engage an outer surface of a tubular, the engagement portion comprising a V-configuration engagement surface comprising an obtuse angle defining a lengthwise central groove traversing the engagement length.

The presently described subject matter is further directed to any acoustic housing as described herein, comprising a cover comprising a first (optionally chamfered) perimeter defining an open cover portion, and having a cover length and a cover height; and a body comprising a second (optionally chamfered) perimeter defining an open body portion configured to receive one or more electrical components and to sealingly engage with the first perimeter, the first perimeter and the second perimeter are each configured such that upon engagement, a perimeter space is defined therebetween, the body having a body length, a body height, and an under-surface, and an engagement portion projecting from the under-surface and having an engagement length, an engagement height, and an engagement surface configured to engage an outer surface of a tubular. The minimum requirement to ensure the housing cover and body can be sealed is to have at least one chamfered perimeter; either on the housing cover or body.

The presently described subject matter is directed to a system for downhole telemetry, comprising a tubular body having a pin end, a box end, and an elongated wall between the pin end and the box end, with the tubular body being fabricated from a steel material; and a communications node comprising a sealed acoustic housing comprising an acoustic housing according to the presently described subject matter, the acoustic housing fabricated from a steel material having a resonance frequency, an independent power source residing within acoustic housing, an electro-acoustic transducer and associated transceiver residing within the acoustic housing for receiving and transmitting acoustic waves, and at least one clamp for radially clamping the communications node onto an outer surface of the tubular body.

The presently described subject matter is directed to any system for downhole telemetry as described herein, wherein the tubular body is a joint of drill pipe, a joint of casing, a joint of production tubing, or a joint of a liner string.

The presently described subject matter is further directed to any system for downhole telemetry as described herein, wherein the acoustic housing of the communications node comprises a first end and a second opposite end; and the at least one clamp comprises a first clamp secured at the first end of the housing, and a second clamp secured at the second end of the housing.

The presently described subject matter is further directed to a communication node, comprising a sealed acoustic housing comprising the acoustic housing according to the presently described subject matter; an independent power source residing within the acoustic housing; one or more electro-acoustic transducers to provide telemetry and associated transmitter, receiver, or transceiver residing within the acoustic housing and configured to receive and relay acoustic waves; and a circuit board residing within the acoustic housing.

The presently described subject matter is further directed to any communication node according to the presently described subject matter, further comprising at least one sensor residing within the acoustic housing.

The presently described subject matter is directed to any communication node accordingly to the presently described subject matter that can further comprise at least one sensor that can comprise or consist of, but is not limited to, one or more of a pressure sensor, a temperature sensor, an induction log, a gamma ray log, a formation density sensor, a sonic velocity sensor, a vibration sensor, a resistivity sensor, a flow meter, a microphone, a geophone, a chemical sensor, or one or more position sensors.

The presently described subject matter is also directed to an electro-acoustic system for wireless telemetry along a tubular body, comprising a tubular body; at least one sensor disposed along the tubular body; a sensor communications node placed along the tubular body and connected to a wall of the tubular body, the sensor communications node being in electrical communication with the at least one sensor and configured to receive signals from the at least one sensor, the signals representing a parameter associated with a subsurface location along the tubular body; a topside communications node placed proximate a surface or subsurface; a plurality of intermediate communications nodes spaced along the tubular body and attached to an outer wall of the tubular body, the intermediate communications nodes configured to transmit acoustic waves from the sensor communications node to the topside communications node in node-to-node arrangement; and a transmitter/receiver at the surface configured to receive signals from the topside communications node or to transmit signals to the topside communications node; each of the sensor communication node and the intermediate communications nodes comprising a sealed acoustic housing comprising the acoustic housing according to the presently described subject matter, an independent power source residing within the sealed acoustic housing, and one or more electro-acoustic transducers to provide telemetry and associated transmitter, receiver, or transceiver residing within the acoustic housing and configured to receive and relay the acoustic waves, thereby providing communications telemetry, wherein the acoustic waves represent asynchronous packets of information comprising a plurality of separate tones, with at least some of the acoustic waves being indicative of the parameter.

The sensor communications node is in electrical communication with the (one or more) sensors. This may be by means of a short wire, or by means of wireless communication such as acoustic, infrared or radio waves. The sensor communications node can be configured to receive signals from the sensors, wherein the signals represent a subsurface condition or parameter such as temperature or pressure. The sensor may be contained in the housing of the communications node. The sensor communications node is then placed at the depth of the subsurface formation. The sensor communications node is in communication with the at least one sensor. This can be a short wired connection or a connection through a circuit hoard. Alternatively, the communication could be acoustic or radio frequency (RF), particularly in the case when the sensor and communications nodes are not in the same housing. The sensor communications node is configured to receive signals from the at least one sensor. The signals represent a subsurface condition such as temperature, pressure, pipe strain, fluid flow or fluid composition, or geology.

The presently described subject matter is also directed to any electro-acoustic system for wireless telemetry along a tubular body according to the presently described subject matter, wherein the tubular body comprises at least two pipe joints disposed in a wellbore, with the wellbore penetrating into a subsurface formation, and the at least one sensor and the sensor communications node are disposed along the wellbore proximate a depth of the subsurface formation.

The presently described subject matter is directed to any electro-acoustic system for wireless telemetry along a tubular body according to the presently described subject matter, wherein the parameter can comprise temperature, pressure, pressure drop, fluid flow, fluid composition, strain, or geological information related to a rock matrix of the subsurface formation.

The presently described subject matter is also directed to any electro-acoustic system for wireless telemetry along a tubular body according to the presently described subject matter, wherein the at least one sensor comprises a pressure sensor, a temperature sensor, an induction log, a gamma ray log, a formation density sensor, a sonic velocity sensor, a vibration sensor, a resistivity sensor, a flow meter, a microphone, a geophone, a chemical sensor, or a set of position sensors. The at least one sensor may or may not reside in the housing of the sensor communication node.

The presently described subject matter is directed to a method of transmitting data in a wellbore, comprising providing a sensor along the wellbore at a depth of a subsurface formation, the sensor optionally residing within a housing of a sensor communications node; running joints of pipe into the wellbore, the joints of pipe being connected by threaded couplings; attaching a series of communications nodes to the joints of pipe according to a pre-designated spacing, wherein adjacent communications nodes are configured to communicate by acoustic signals transmitted through the joints of pipe; providing a receiver at a surface; and sending signals from the sensor to the receiver via the series of communications nodes, with the signals being indicative of a subsurface condition, wherein each of the sensor communications node and the communications nodes comprises a sealed acoustic housing comprising the acoustic housing according to the presently described subject matter, one or more electrical components, including for example, electro-acoustic transducers to provide telemetry and associated transmitter, receiver, or transceiver residing within the acoustic housing configured to send and receive acoustic signals between nodes, and an independent power source also residing within the acoustic housing for providing power to the transceiver.

Electrical components can include, but are not limited to, one or more of a battery, a power supply wire, a transceiver, and a circuit board. The circuit board can include a microprocessor or electronics module that processes acoustic signals. An electro-acoustic transducer can be provided to convert acoustical energy to electrical energy (or vice-versa). The transducer is in electrical communication with at least one sensor.

The presently described subject matter is directed to an electro-acoustic system for allowing telemetry along a tubular body. The system can include a tubular body; at least one sensor disposed along the tubular body; a sensor communications node placed along the tubular body and connected to a wall of the tubular body, the sensor communications node being in electrical communication with the at least one sensor and configured to receive signals from the at least one sensor, the signals representing a parameter associated with a subsurface location along the tubular body, the sensor may reside within the sensor communications node; a topside communications node placed proximate a surface; a plurality of intermediate communications nodes spaced along the tubular body and attached to an outer wall of the tubular body, the intermediate communications nodes configured to transmit acoustic waves from the sensor communications node to the topside communications node in node-to-node arrangement; and a transmitter/receiver at the surface configured to receive signals from the topside communications node or to transmit signals to it; the transmitter/receiver may also communicate directly with other downhole nodes, by-passing the topside communications node; each of the topside communications node, the sensor communication node and the intermediate communications nodes comprising a sealed acoustic housing as presently described herein; an independent power source residing within the sealed acoustic housing; and one or more electro-acoustic transducers to provide telemetry and associated transmitter, receiver, or transceiver residing within the sealed acoustic housing and configured to receive and relay the acoustic waves, thereby providing communications telemetry, wherein acoustic waves represent asynchronous packets of information comprising a plurality of separate tones.

In an aspect of the presently described system, at least some of the acoustic waves can be indicative of the parameter.

The presently described subject matter is further directed to a method of transmitting data in a wellbore, including providing a sensor along the wellbore at a depth of a subsurface formation, the sensor optionally residing within a housing of a sensor communications node; running joints of pipe into the wellbore, the joints of pipe being connected by threaded couplings; attaching a series of communications nodes to the joints of pipe according to a pre-designated spacing, wherein adjacent communications nodes are configured to communicate by acoustic signals transmitted through the joints of pipe; providing a receiver at a surface; and sending signals from the sensor to the receiver via the series of communications nodes, with the signals being indicative of a subsurface condition; wherein each of the sensor communications node and the communications nodes comprises: a sealed acoustic housing as presently described herein; one or more electro-acoustic transducers to provide telemetry and associated transmitter, receiver, or transceiver residing within the housing configured to send and receive acoustic signals between nodes; and an independent power source also residing within the acoustic housing for providing power to the transmitter, receiver, or transceiver.

Communications nodes according to the presently described subject matter can utilize two-way electro-acoustic transducers to both receive and relay mechanical waves. The nodes can include a plurality of intermediate communications nodes. Each of the intermediate communications nodes can reside between the sensor node and the topside node. The intermediate communications nodes are configured to receive and then relay acoustic signals along the length of a wellbore. The intermediate communications nodes can utilize two-way electro-acoustic transducers to both receive and relay mechanical waves. The electro-acoustic transducer may be a two-way transceiver that can both receive and transmit acoustic signals. The two-way electro-acoustic transducer in each node allows acoustic signals to be sent from node-to-node, either up the wellbore or down the wellbore. These nodes allow for the high speed transmission of wireless signals based on the in situ generation of acoustic waves.

The presently described subject matter is directed to a system, for example, that first includes a tubular body disposed in the wellbore. Where the wellbore is being formed, the tubular body is a drill string, with the wellbore progressively penetrating into a subsurface formation. The subsurface formation preferably represents a rock matrix having hydrocarbon fluids available for production in commercially acceptable volumes. Thus, the wellbore is to be completed as a production well, or "producer." Alternatively, the wellbore is to be completed as either an injection well or a formation monitoring well.

The presently described subject matter is also directed to a system where, for example, the wellbore is being completed or has already been completed. The tubular body is then a casing string or, alternatively, a production string such as tubing. In either instance, the tubular body is made up of a plurality of pipe joints that are threadedly connected end-to-end. Each joint of pipe has a conductive wire extending substantially from one end of the joint, along the pipe body to the other end of that joint. The ends of the pipe joint may include a threaded male end ("pin") or female end ("box"), and may or may not include a collar, coupling, or connector sub that joins the joint of pipe with an adjacent joint of pipe. In other arrangements, one end of the joint may be a pin while the other end of the joint is a box. The subject matter of this disclosure is applicable to any arrangement of the joint connection types.

The sensor communications node is configured to receive signals from the at least one sensor. The signals represent a subsurface condition such as temperature, fluid flow volume, fluid resistivity, fluid identification, ambient noise, acoustic attenuation, the presence of elastic waves, or pressure. The sensor communications node can include a sealed housing for containing electronic components.

The system can also comprise a topside communications node. The topside communications node can be placed along the wellbore proximate the surface, at the wellhead, in the wellhead cellar, or subsurface. The surface may be an earth surface. Alternatively, in a subsea context, the surface may be an offshore platform such as a floating production storage and offloading unit (FPSO), a floating ship-shaped vessel, or offshore rig.

The system may further include a plurality of intermediate communications nodes. The intermediate communications nodes are attached to, for example, each joint of pipe making up the tubular body, in pairs. The intermediate communications nodes are configured to transmit electro-acoustic waves from the sensor communications node to the topside communications node.

Each of the intermediate communications nodes has an independent power source. The power source may be, for example, batteries or a fuel cell. In addition, each of the intermediate communications nodes can include an electro-acoustic transceiver. The transceiver is designed to communicate with an adjacent communications node using electrical signals carried through the conductive wire in the pipe joint, and using acoustic signals that cross joint couplings along the tubular body.

The acoustic tones characterize the data generated by the sensor. In this way, data about subsurface conditions is transmitted from node-to-node up to the surface. In one aspect, the communications nodes transmit data as acoustic waves at a rate exceeding about 50 bps. In a preferred embodiment, multiple frequency shift keying (MFSK) is the modulation scheme enabling the transmission of information.

A separate method of transmitting data in a wellbore is also provided herein. The method uses a plurality of data transmission nodes situated along a tubular body to accomplish a wired, wireless, or hybrid wired-and-wireless transmission of data along the wellbore. The wellbore penetrates into a subsurface formation, allowing for the communication of a wellbore condition at the level of the subsurface formation up to the surface.

The method first includes providing a plurality of pipe joints. Each pipe joint has (i) a first end, (ii) a second end, (iii) a tubular wall, and (iv) a conductive wire embedded into or otherwise placed along the wall. The conductive wire extends substantially from the first end to the second end. Each of the first and second ends of a joint of tubular pipe may be a pin end or each end may be a box end, or one end may be a pin end while the second end is a box end (for directly receiving a pin therein), to form a connection with and adjacent joint of pipe. Pipe joints having pins on each end or boxes on each end require a coupling such as a collar or connector sub to connect with an adjacent pipe joint.

The method also includes running the plurality of pipe joints into the wellbore. This is done by threadedly connecting the respective the second end of one joint of pipe with the first end of an adjacent joint of pipe, thereby forming an elongated tubular body. The method also includes attaching communications and/or sensor nodes to an outer surface of the tubular body. These nodes can be attached anywhere along the tubular joint. In an exemplarily case, the nodes would not be attached immediately adjacent to the pin and box ends of the tubular joint.

In the presently described method, the attaching steps can comprise clamping the various communications nodes to the tubular body utilizing one or more clamps. The communications nodes can be secured around the tubular body via the clamps, where a clamp secures each tab end of the communication node, for example, during run-in.

In some aspects, one or more communications nodes are not welded or otherwise pre-attached to the one or more clamps. Clamp pre-attachment via, for example, welding, may introduce fabrication difficulties when installing electronics and piezo disks. The presently described method may further include placing or otherwise providing at least one sensor along the wellbore. The sensor is placed at a depth of the subsurface formation. The sensor may be any sensor as described herein.

The method may further include attaching a sensor communications node to the tubular body. The sensor communications node is then placed at the depth of the subsurface formation. The sensor communications node is in electrical communication with the at least one sensor. This is preferably by means of a short wired connection. In one aspect, the sensor resides within the housing of a sensor communications node. In any event, the sensor communications node is configured to receive signals from the at least one sensor. The signals represent a subsurface condition/parameter such as temperature, pressure, inclination, the presence of elastic (or seismic) waves, fluid composition, fluid resistivity, formation density, or geology.

The method may also provide for attaching a topside communications node to the tubular body or other structure, such as the wellhead or the blow-out preventer, i.e., "BOP," that is connected to the tubular body. The topside communications node is provided along the wellbore proximate the surface.

The method can further comprise transmitting an electro-acoustic signal from the sensor and up the wellbore from node-to-node. This is done through an electro-acoustic transducer and associated transmitter, receiver, or transceiver that resides within each node. Additionally, the transmitter, receiver, or transceiver communicate with an adjacent communications node on an adjacent pipe joint through acoustic signals that are sent across joint couplings along the tubular body. The acoustic signals correlate to the electrical signals.

In one aspect, the method may further include receiving a signal from the topside communications node at a receiver. The receiver can receive electrical or optical signals from the topside communications node. In accordance with the presently described subject matter, the electrical or optical signals are conveyed in a conduit suitable for operation in an electrically classified area, that is, via a so-called "Class I, Division I" conduit (as defined by NFPA 497 and API 500). Alternatively, data can be transferred from the topside communications node to a receiver via an electromagnetic (RF) wireless connection. The electrical signals may then be processed and analyzed at the surface.

The presently described subject matter is directed to an electro-acoustic system for wireless telemetry along a tubular body, comprising a tubular body; at least one sensor disposed along the tubular body; a sensor communications node placed along the tubular body and connected to a wall of the tubular body, the sensor communications node being in electrical communication with the at least one sensor and configured to receive signals from the at least one sensor, the signals representing a parameter associated with a subsurface location along the tubular body; a topside communications node placed proximate a surface or subsurface; a plurality of intermediate communications nodes spaced along the tubular body and attached to an outer wall of the tubular body, the intermediate communications nodes configured to transmit acoustic waves from the sensor communications node to the topside communications node in node-to-node arrangement; and a transmitter/receiver at the surface configured to receive signals from the topside communications node or to transmit signals to the topside communications node; each of the sensor communication node and the intermediate communications nodes comprising a sealed acoustic housing according to the presently described subject matter, an independent power source residing within the sealed acoustic housing, and one or more electro-acoustic transducers to provide telemetry and associated transmitter, receiver, or transceiver residing within the acoustic housing and configured to receive and relay the acoustic waves, thereby providing communications telemetry, wherein the acoustic waves represent asynchronous packets of information comprising a plurality of separate tones, with at least some of the acoustic waves being indicative of the parameter. The parameter can comprise, but is not limited to, one or more of temperature, pressure, fluid flow, flow type, fluid composition, strain, or geological information related to a rock matrix of the subsurface formation.

The presently described subject matter is directed to an electro-acoustic system where the tubular body can comprise at least two pipe joints disposed in a wellbore, with the wellbore penetrating into a subsurface formation, and the at least one sensor and the sensor communications node are disposed along the wellbore proximate a depth of the subsurface formation.

The presently described subject matter is directed to a method of transmitting data in a wellbore, comprising providing a sensor along the wellbore at a depth of a subsurface formation, the sensor optionally residing within a housing of a sensor communications node; running joints of pipe into the wellbore, the joints of pipe being connected by threaded couplings; attaching a series of communications nodes to the joints of pipe according to a pre-designated spacing, wherein adjacent communications nodes are configured to communicate by acoustic signals transmitted through the joints of pipe; providing a receiver at a surface; and sending signals from the sensor to the receiver via the series of communications nodes, with the signals being indicative of a subsurface condition, wherein each of the sensor communications node and the communications nodes comprises: a sealed acoustic housing according to the presently described subject matter; one or more electro-acoustic transducers to provide telemetry and associated transmitter, receiver, or transceiver residing within the acoustic housing configured to send and receive acoustic signals between nodes; and an independent power source also residing within the acoustic housing for providing power to the transceiver.

BRIEF DESCRIPTION OF THE DRAWINGS

The present disclosure is susceptible to various modifications and alternative forms, specific exemplary implementations thereof have been shown in the drawings and are herein described in detail. It should be understood, however, that the description herein of specific exemplary implementations is not intended to limit the disclosure to the particular forms disclosed herein.

This disclosure is to cover all modifications and equivalents as defined by the appended claims. It should also be understood that the drawings are not necessarily to scale, emphasis instead being placed upon clearly illustrating principles of exemplary embodiments of the present invention. Moreover, certain dimensions may be exaggerated to help visually convey such principles. Further where considered appropriate, reference numerals may be repeated among the drawings to indicate corresponding or analogous elements. Moreover, two or more blocks or elements depicted as distinct or separate in the drawings may be combined into a single functional block or element. Similarly, a single block or element illustrated in the drawings may be implemented as multiple steps or by multiple elements in cooperation.

The forms disclosed herein are illustrated by way of example, and not by way of limitation, in the figures of the accompanying drawings and in which like reference numerals refer to similar elements and in which:

Figure 1:
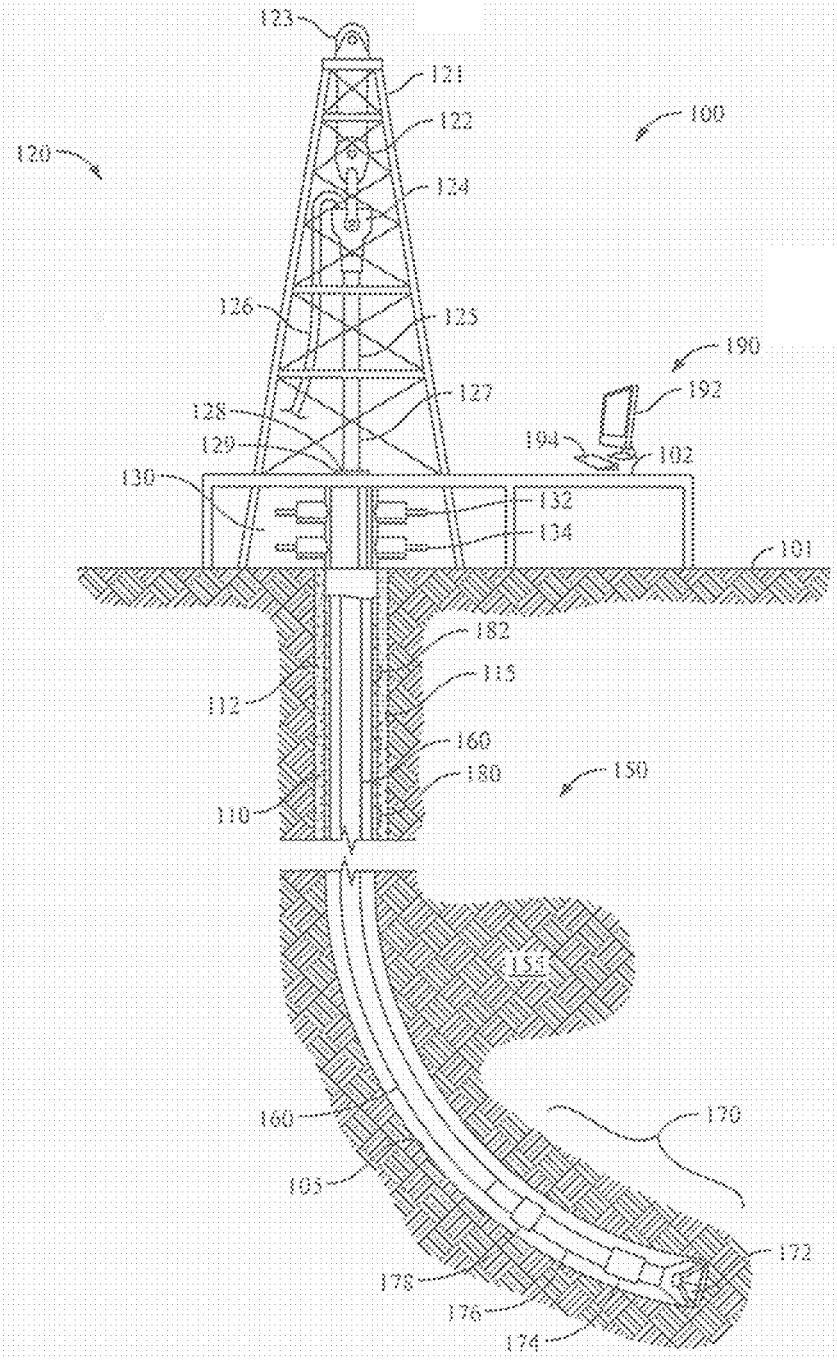
Figure 2:
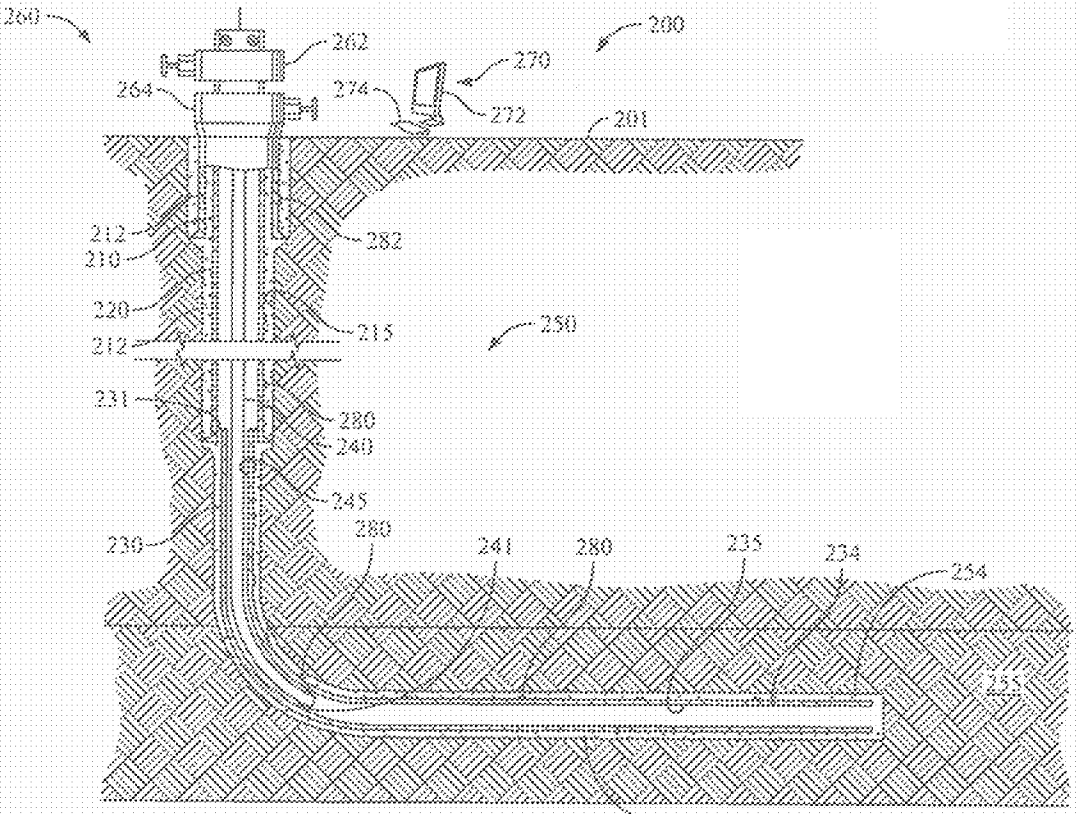
Figure 3A:
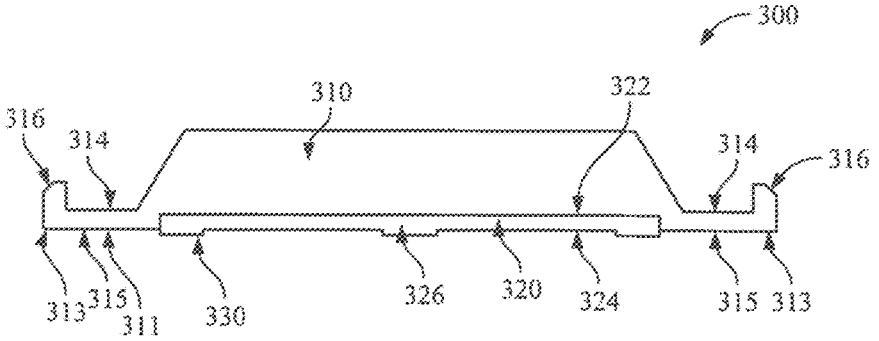
Figure 3B:
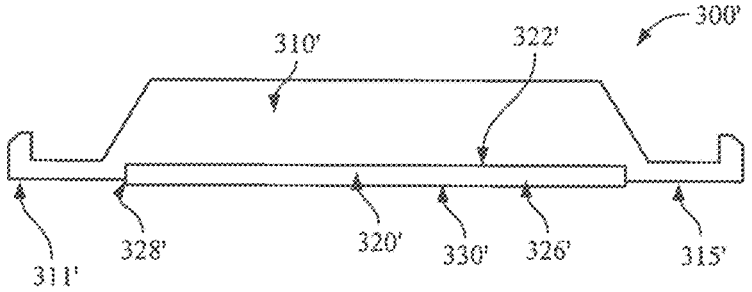
Figure 3C:
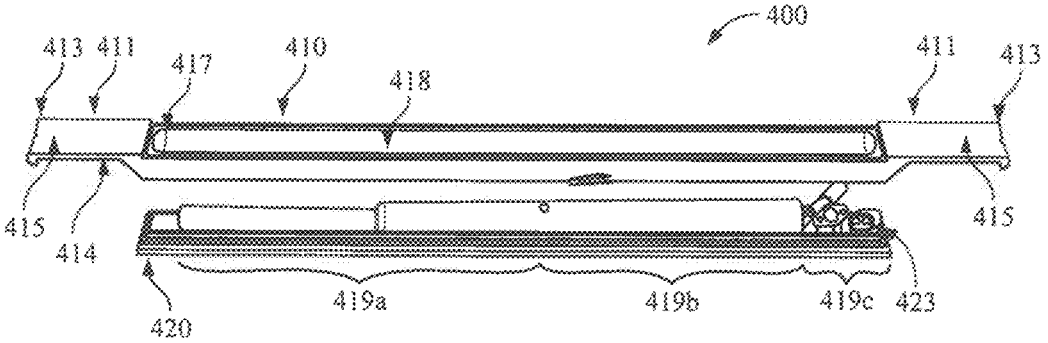
Figure 4A:
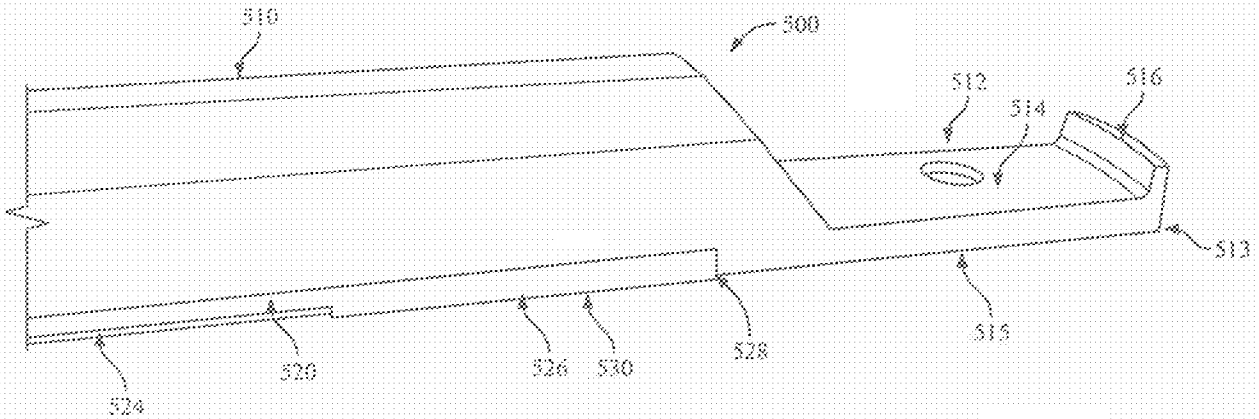
Figure 4B:
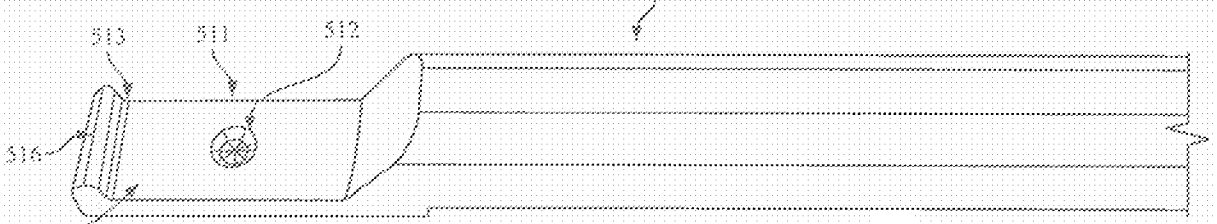
Figure 4C:
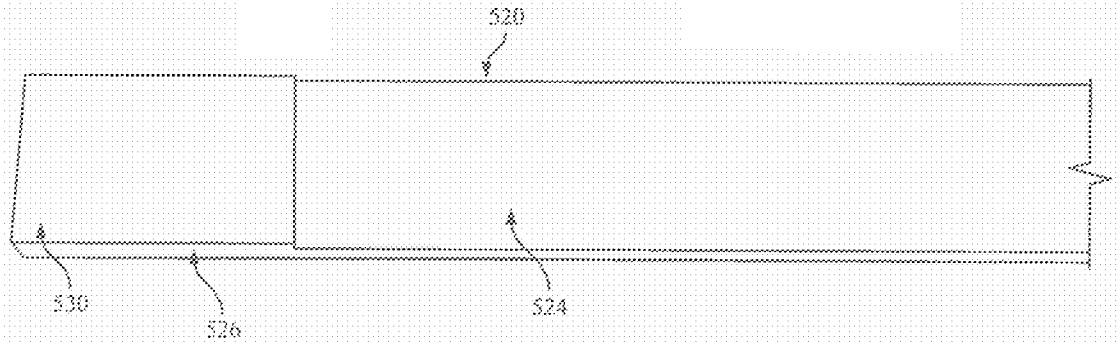
Figure 4D:
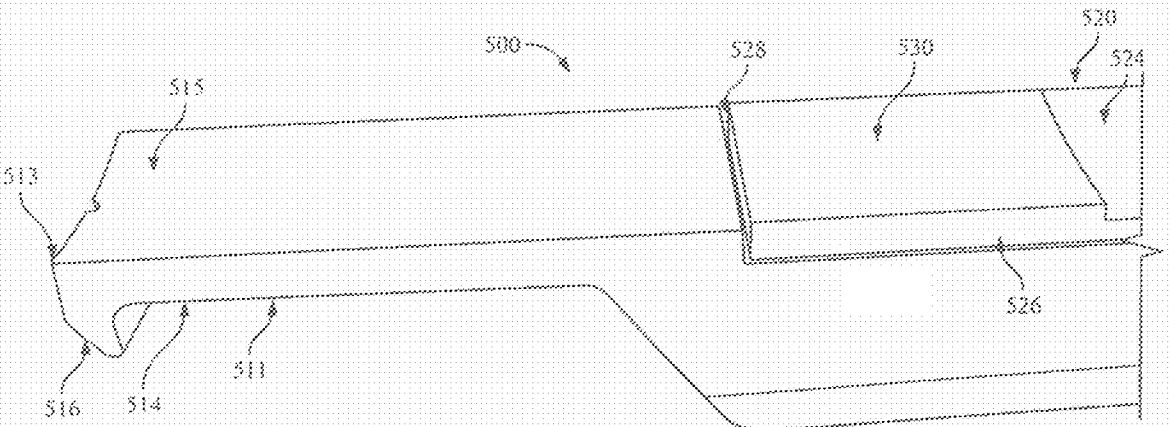
Figure 5A:
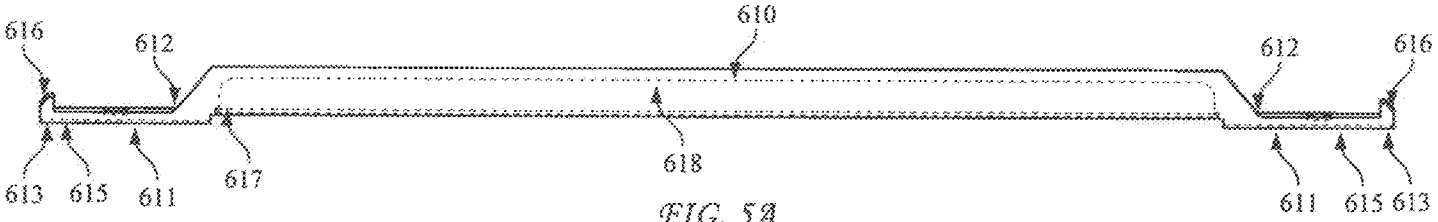
Figure 5B:
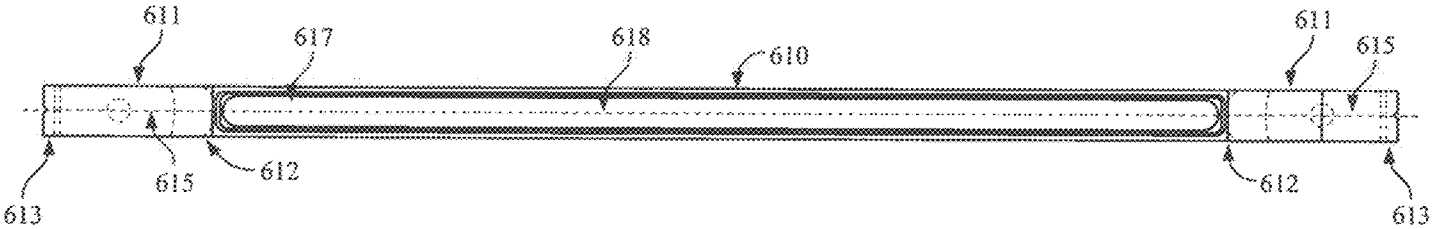
Figure 5C:
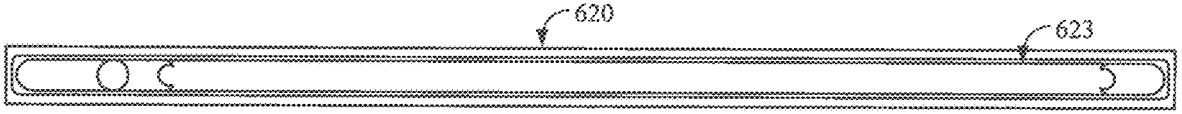
Figure 5D:
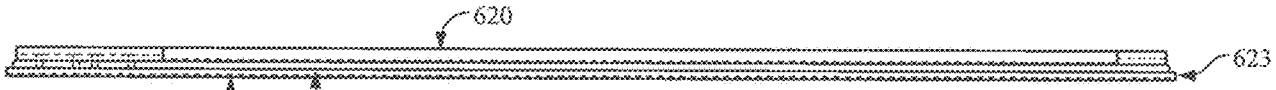
Figure 5E:
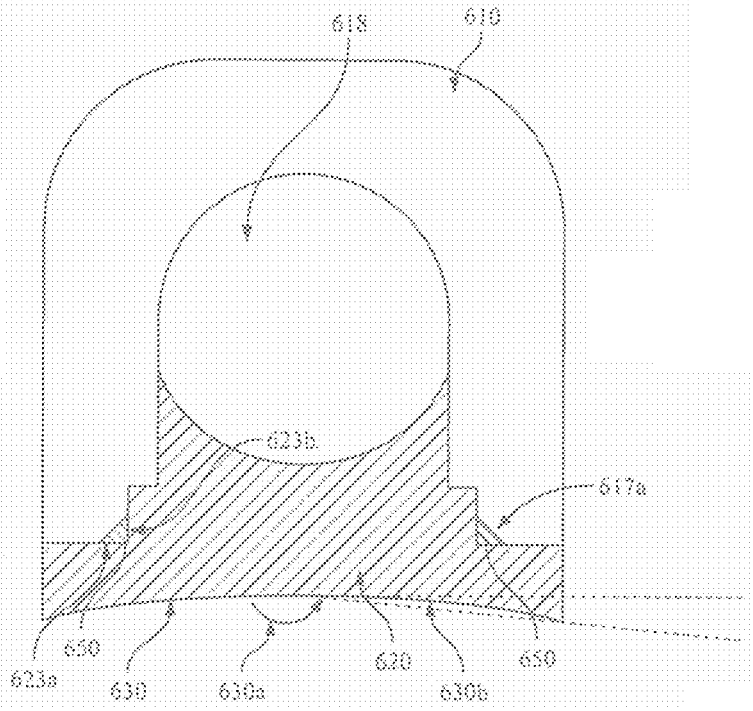
Figure 5F:
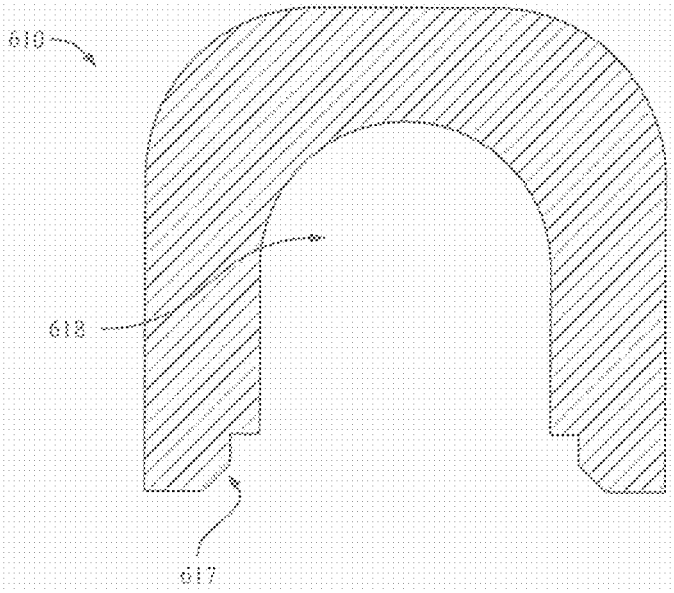
Figure 5G:
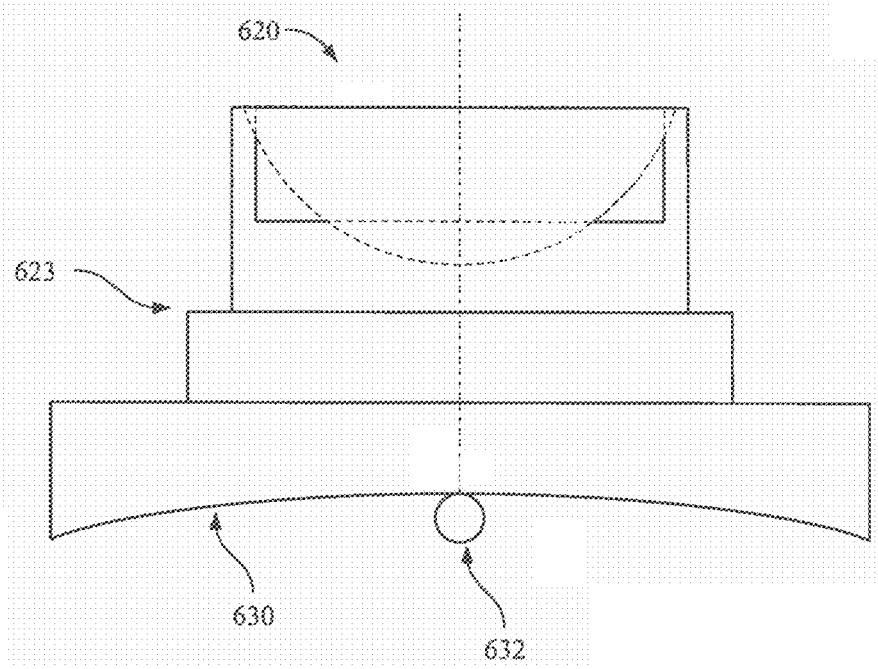
Figure 6:
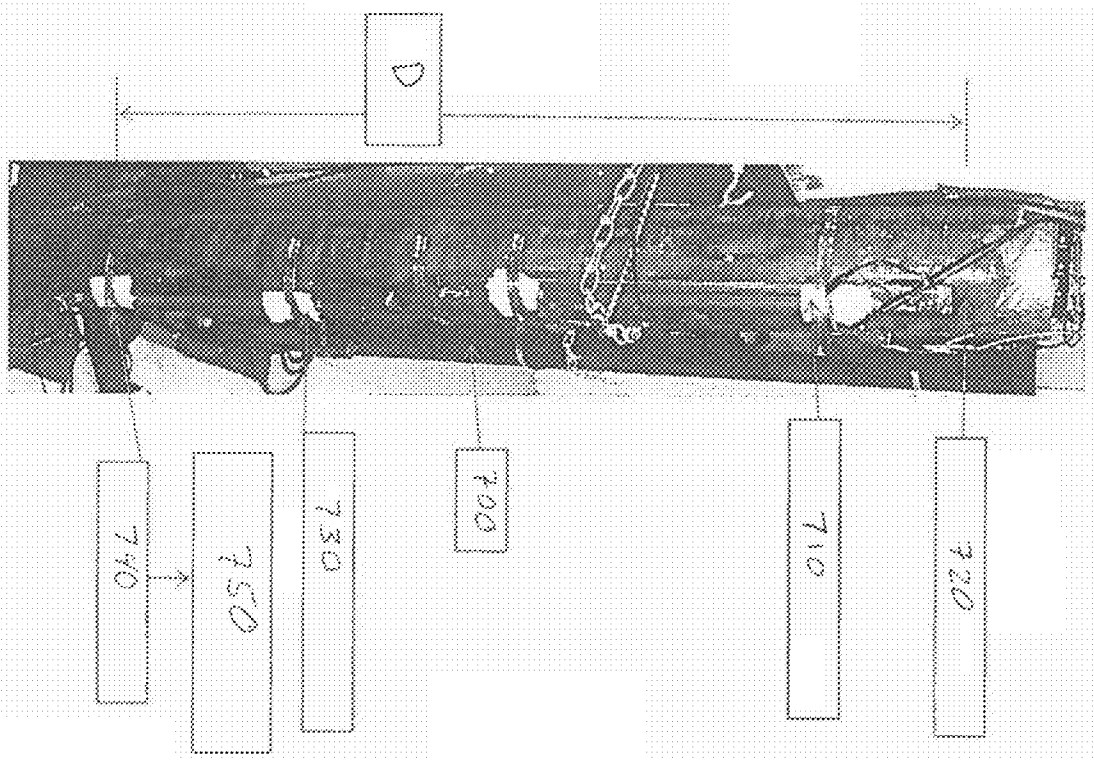
Figure 7:
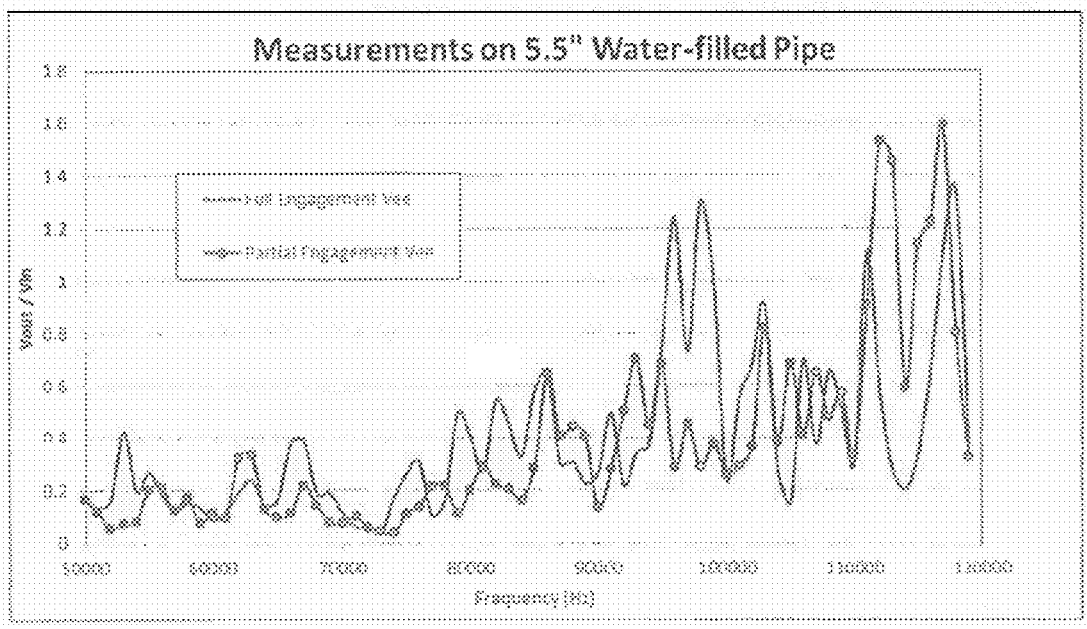
Figure 8:
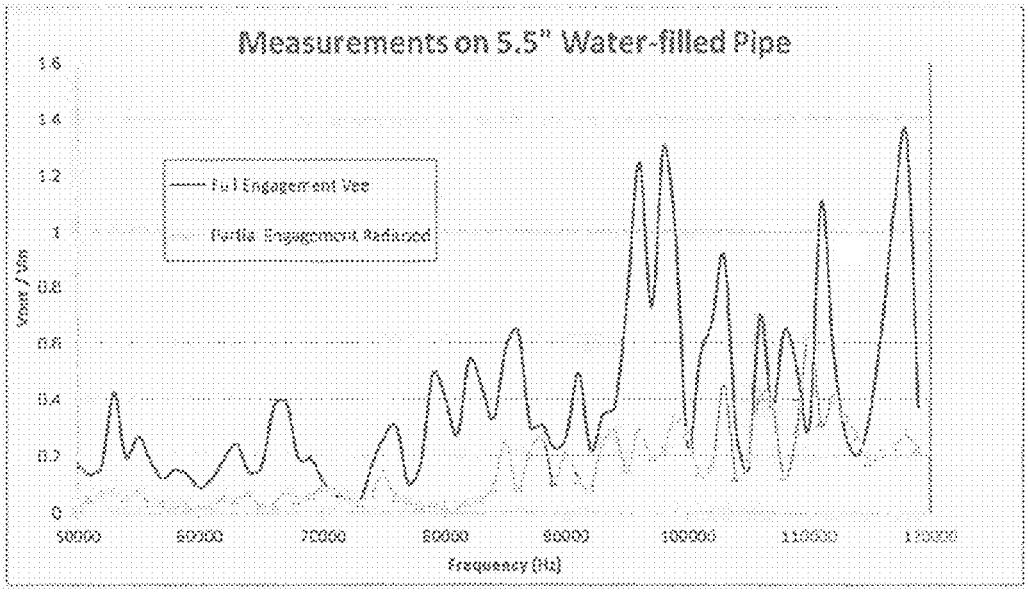
Figure 9:
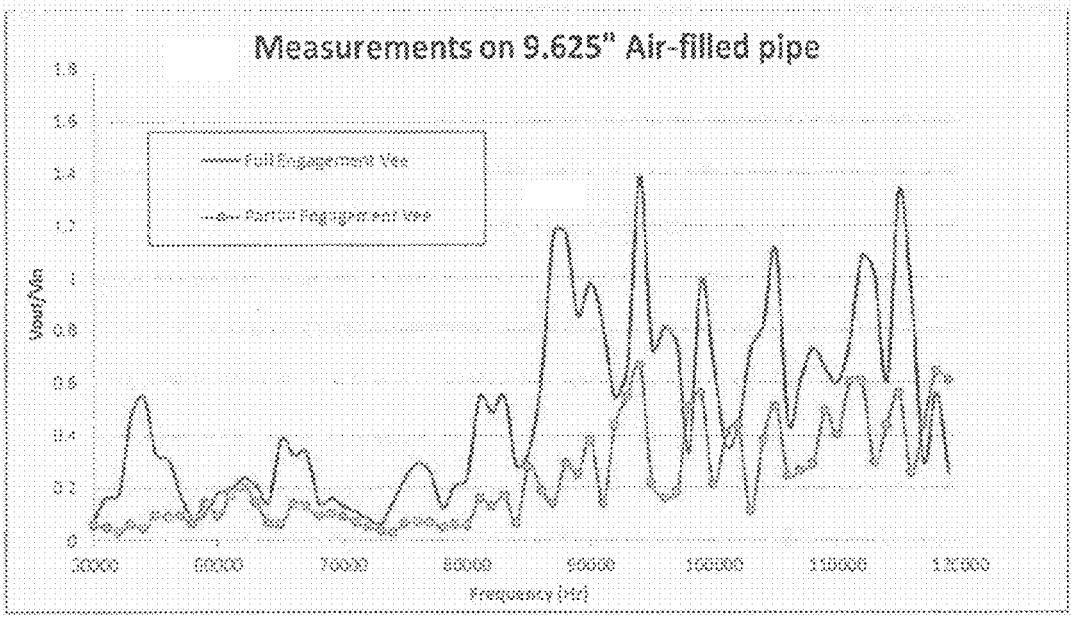
Figure 10:
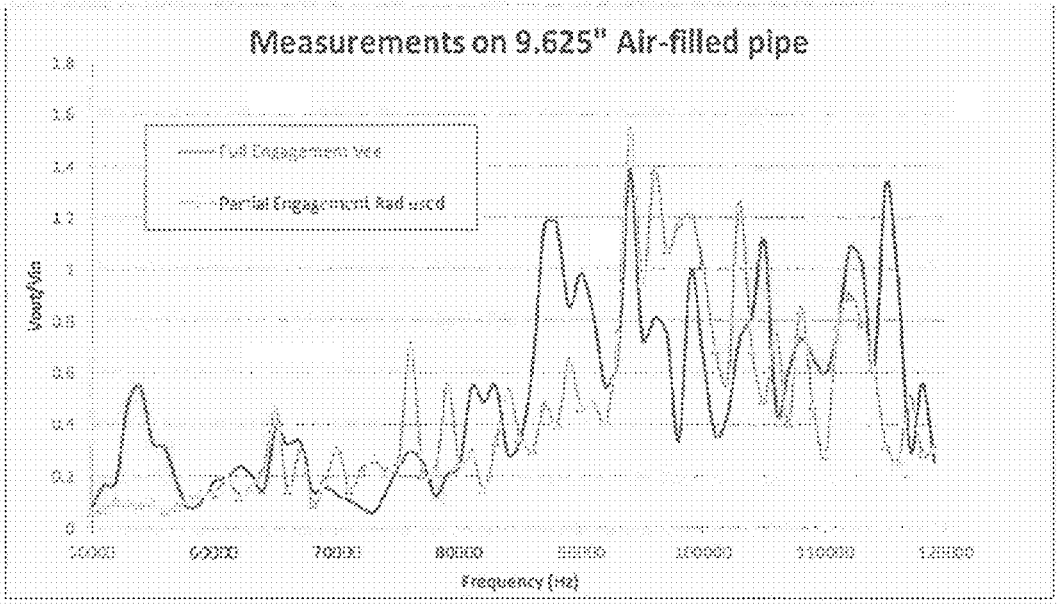
Figure 11:
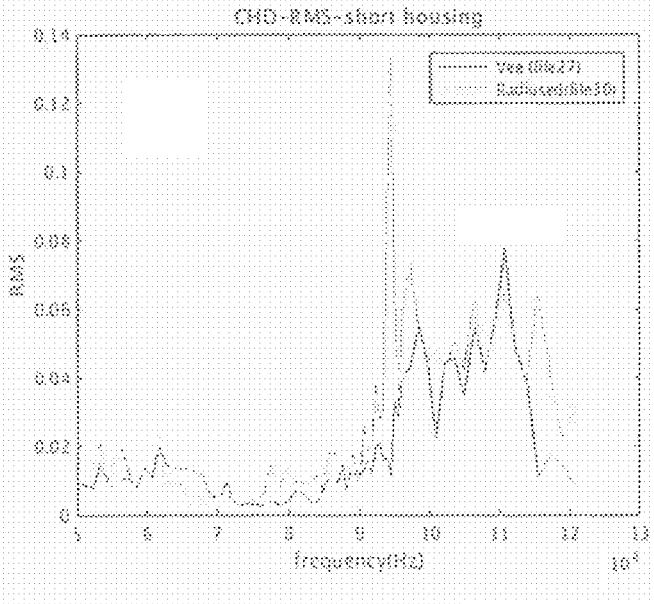
Figure 12:
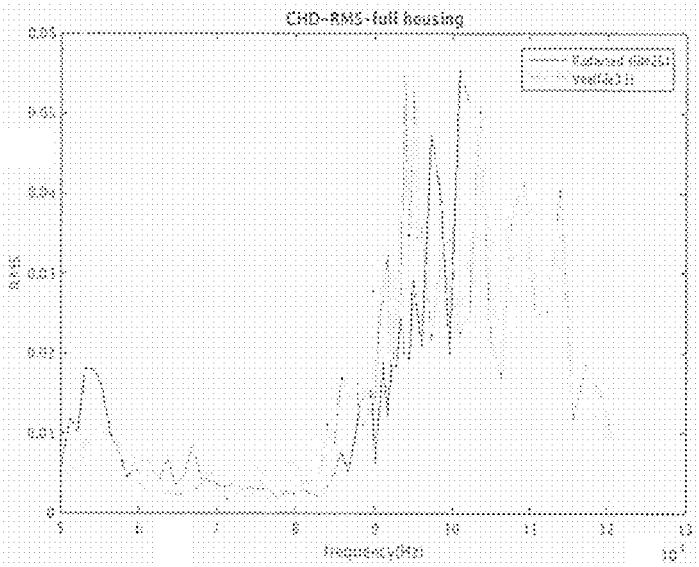

FIG. 1 presents a side, cross-sectional view of an illustrative, nonexclusive example of a wellbore. The wellbore is being formed using a derrick, a drill string and a bottom hole assembly. A series of communications nodes is placed along the drill string as part of a telemetry system, according to the present disclosure;

FIG. 2 presents a cross-sectional view of an illustrative, nonexclusive example of a wellbore having been completed. The illustrative wellbore has been completed as a cased hole completion. A series of communications nodes is placed along the casing string as part of a telemetry system, according to the present disclosure;

FIG. 3A presents a side view of an illustrative, nonexclusive example of a communications node;

FIG. 3B presents a side view of an additional illustrative, nonexclusive example of a communications node, according to the present disclosure;

FIG. 3C presents a perspective/view of an illustrative, nonexclusive example of a communications node before the cover and the body are sealed together, according to the present disclosure;

FIG. 4A presents a perspective partial view of a further illustrative, nonexclusive example of a communications node, according to the present disclosure;

FIG. 4B presents a perspective partial view of an illustrative, nonexclusive example of a housing cover, according to the present disclosure;

FIG. 4C presents a partial bottom view of an illustrative, nonexclusive example of a housing body, according to the present disclosure;

FIG. 4D presents a perspective partial bottom view of an illustrative, nonexclusive example of a communications node including a body and a cover, according to the present disclosure;

FIGS. 5A-D present views of illustrative, nonlimiting, examples according the presently described subject matter of the a housing cover and body, a side view of the housing cover (FIG. 5A), a bottom view of the housing cover (FIG. 5B), a top-down view of the housing body (FIG. 5C), and a side view of the housing body (FIG. 5D), according to the present disclosure;

FIG. 5E presents a cross-section view of an illustrative, nonexclusive example of a housing including a body and a cover sealed with a sealing material, according to the present disclosure;

FIG. 5F presents a cross-section view of an illustrative, nonexclusive example of a housing cover taken along section A-A of FIG. 5A, according to the present disclosure;

FIG. 5G presents a cross-section view of an illustrative, nonexclusive example of a housing body taken along section B-B of FIG. 5D, according to the present disclosure;

FIG. 6 presents an illustrative, nonlimiting, example of a testing layout according to the presently described subject matter;

FIG. 7 presents frequency response as measured at the receiving node housing comparing full and partial V-configuration engagement surfaces;

FIG. 8 presents frequency response as measured at the receiving node housing comparing a full V-configuration engagement surface to a partial radiused configuration engagement surface;

FIG. 9 presents frequency response as measured at the receiving node housing where both housings are mounted on a 9⅝ inch air-filled casing, where a full V-configuration engagement surface is compared with a partial V-configuration engagement surface;

FIG. 10 presents frequency response as measured at the receiving node housing where both housings are mounted on a 9⅝ inch air-filled casing, where a full V-configuration engagement surface is compared with a partial radius engagement surface;

FIG. 11 presents a direct comparison of identical engagement lengths to compare radiused and V-configuration geometries; and FIG. 12 presents a direct comparison of identical engagement lengths to compare radiused and V-configuration geometries.

DETAILED DESCRIPTION

Definitions

The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than the broadest meaning understood by skilled artisans, such a special or clarifying definition will be expressly set forth in the specification in a definitional manner that provides the special or clarifying definition for the term or phrase.

For example, the following discussion contains a non-exhaustive list of definitions of several specific terms used in this disclosure (other terms may be defined or clarified in a definitional manner elsewhere herein). These definitions are intended to clarify the meanings of the terms used herein. It is believed that the terms are used in a manner consistent with their ordinary meaning, but the definitions are nonetheless specified here for clarity.

A/an: The articles "a" and "an" as used herein mean one or more when applied to any feature in embodiments and implementations of the present invention described in the specification and claims. The use of "a" and "an" does not limit the meaning to a single feature unless such a limit is specifically stated. The term "a" or "an" entity refers to one or more of that entity. As such, the terms "a" (or "an"), "one or more" and "at least one" can be used interchangeably herein.

About: As used herein, "about" refers to a degree of deviation based on experimental error typical for the particular property identified. The latitude provided the term "about" will depend on the specific context and particular property and can be readily discerned by those skilled in the art. The term "about" is not intended to either expand or limit the degree of equivalents which may otherwise be afforded a particular value. Further, unless otherwise stated, the term "about" shall expressly include "exactly," consistent with the discussion below regarding ranges and numerical data.

Above/below: In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore. Continuing with the example of relative directions in a wellbore, "upper" and "lower" may also refer to relative positions along the longitudinal dimension of a wellbore rather than relative to the surface, such as in describing both vertical and horizontal wells.

Configured: As used herein the term "configured" means that the element, component, or other subject matter is designed to perform a given function. Thus, the use of the term "configured" should not be construed to mean that a given element, component, or other subject matter is simply "capable of" performing a given function but that the element, component, and/or other subject matter is specifically selected, created, implemented, utilized, programmed, and/or designed to perform that function.

And/or: The term "and/or" placed between a first entity and a second entity means one of (1) the first entity, (2) the second entity, and (3) the first entity and the second entity. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements). As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of".

Any: The adjective "any" means one, some, or all indiscriminately of whatever quantity.

At least: As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements). The phrases "at least one", "one or more", and "and/or" are open-ended expressions that are both conjunctive and disjunctive in operation. For example, each of the expressions "at least one of A, B, and C", "at least one of A, B, or C", "one or more of A, B, and C," "one or more of A, B, or C" and "A, B, and/or C" means A alone, B alone, C alone, A and B together, A and C together, B and C together, or A, B and C together.

Based on: "Based on" does not mean "based only on", unless expressly specified otherwise. In other words, the phrase "based on" describes both "based only on," "based at least on," and "based at least in part on."

Comprising: In the claims, as well as in the specification, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

Couple: Any use of any form of the terms "connect", "engage", "couple", "attach", or any other term describing an interaction between elements is not meant to limit the interaction to direct interaction between the elements and may also include indirect interaction between the elements described.

Determining: "Determining" encompasses a wide variety of actions and therefore "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing, and the like.

Exemplary: "Exemplary" is used exclusively herein to mean "serving as an example, instance, or illustration." Any embodiment described herein as "exemplary" is not necessarily to be construed as preferred or advantageous over other embodiments.

May: Note that the word "may" is used throughout this application in a permissive sense (i.e., having the potential to, being able to), not a mandatory sense (i.e., must).

Operatively connected and/or coupled: Operatively connected and/or coupled means directly or indirectly connected for transmitting or conducting information, force, energy, or matter.

Optimizing: The terms "optimal," "optimizing," "optimize," "optimality," "optimization" (as well as derivatives and other forms of those terms and linguistically related words and phrases), as used herein, are not intended to be limiting in the sense of requiring the present invention to find the best solution or to make the best decision. Although a mathematically optimal solution may in fact arrive at the best of all mathematically available possibilities, real-world embodiments of optimization routines, methods, models, and processes may work towards such a goal without ever actually achieving perfection. Accordingly, one of ordinary skill in the art having benefit of the present disclosure will appreciate that these terms, in the context of the scope of the present invention, are more general. The terms may describe one or more of: 1) working towards a solution which may be the best available solution, a preferred solution, or a solution that offers a specific benefit within a range of constraints; 2) continually improving; 3) refining; 4) searching for a high point or a maximum for an objective; 5) processing to reduce a penalty function; 6) seeking to maximize one or more factors in light of competing and/or cooperative interests in maximizing, minimizing, or otherwise controlling one or more other factors, etc.

Order of steps: It should also be understood that, unless clearly indicated to the contrary, in any methods claimed herein that include more than one step or act, the order of the steps or acts of the method is not necessarily limited to the order in which the steps or acts of the method are recited. It is within the scope of the present disclosure that an individual step of a method recited herein may additionally or alternatively be referred to as a "step for" performing the recited action.

Ranges: Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a range of about 1 to about 200 should be interpreted to include not only the explicitly recited limits of 1 and about 200, but also to include individual sizes such as 2, 3, 4, etc. and sub-ranges such as 10 to 50, 20 to 100, etc. Similarly, it should be understood that when numerical ranges are provided, such ranges are to be construed as providing literal support for claim limitations that only recite the lower value of the range as well as claims limitation that only recite the upper value of the range. For example, a disclosed numerical range of 10 to 100 provides literal support for a claim reciting "greater than 10" (with no upper bounds) and a claim reciting "less than 100" (with no lower bounds). In the figures, like numerals denote like, or similar, structures and/or features; and each of the illustrated structures and/or features may not be discussed in detail herein with reference to the figures. Similarly, each structure and/or feature may not be explicitly labeled in the figures; and any structure and/or feature that is discussed herein with reference to the figures may be utilized with any other structure and/or feature without departing from the scope of the present disclosure.

References: In the event that any patents, patent applications, or other references are incorporated by reference herein and define a term in a manner or are otherwise inconsistent with either the non-incorporated portion of the present disclosure or with any of the other incorporated references, the non-incorporated portion of the present disclosure shall control, and the term or incorporated disclosure therein shall only control with respect to the reference in which the term is defined and/or the incorporated disclosure was originally present. In general, structures and/or features that are or are likely to be, included in a given embodiment are indicated in solid lines in the figures, while optional structures and/or features are indicated in broken lines. However, a given embodiment is not required to include all structures and/or features that are illustrated in Definitions.

As used herein, the term "acoustic wave" refers to a sound wave that transmits sound, for example, a tone. Acoustic waves are a type of longitudinal waves that propagate by means of adiabatic compression and decompression. Longitudinal waves are waves that have the same direction of vibration as their direction of travel. Important quantities for describing acoustic waves are sound pressure, particle velocity, particle displacement and sound intensity. Acoustic waves travel with the speed of sound which depends on the medium they are passing through. Acoustic waves can represent a packet of information comprising a plurality of separate tones. The acoustic waves represent the readings taken and data generated by the sensor. A wireless signal can be transmitted using an acoustic wave.

As used herein, the term "chemical bonding material" refers to a chemical bonding material that is capable of sealing a housing cover and housing body as described herein and is able to withstand downhole conditions including, but not limited to, heat, high pressure, and corrosive elements, without significant failure. The chemical bonding material may optionally be used to bond a node to a tubular. The chemical bonding material may or may not facilitate or allow the transmission of ultrasonic energy. Where the chemical bonding material is used for sealing the housing cover and body, it does not need to facilitate transmission of ultrasonic energy. If chemical bonding material is used to bond the node to the tubular, then it must facilitate and allow the transmission of ultrasonic energy.

Suitable chemical bonding materials can include, but are not limited to, one or more of an epoxy, including for example urethane epoxy; CIRCUITWORKS silver-loaded epoxy, RESINLAB EP11HT Gray 2-Part Epoxy, ARALDITE 2-part epoxy, ARALDITE 2014 high temperature, chemical resistant epoxy paste, LOCTITE HYSOL product 907 2-part epoxy; a thermosetting adhesive, including for example, ABLEFILM 5020k; cyanoacrylate including, for example, LOCTITE superglue. Suitable chemical bonding materials can include BAKERLOK.

As used herein, the term "formation" refers to any definable subsurface region. The formation may contain one or more hydrocarbon-containing layers, one or more non-hydrocarbon containing layers, an overburden, and/or an underburden of any geologic formation.

As used herein, the term "hydrocarbon" refers to an organic compound that includes primarily, if not exclusively, the elements hydrogen and carbon. Examples of hydrocarbons include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient conditions (20° C. and 1 atm pressure). Hydrocarbon fluids may include, for example, oil, natural gas, gas condensates, coal bed methane, shale oil, shale gas, and other hydrocarbons that are in a gaseous or liquid state.

As used herein, the term "piezoelectric transducer" refers to a measuring transducer that converts mechanical or acoustic signals, e.g., mechanical stress, into an electric signal. Its operation is based on the piezoelectric effect. Under the action of the signal being measured (pressure), electric charges appear on the external and internal sides of a pair of plates made of a piezoelectric material, e.g., including for example, dielectric crystal or ceramic material. The total electromotive force between the output terminal and the housing varies in proportion to the pressure. The term "piezoelectricity" refers to electricity or electric polarity produced in certain nonconducting crystals when subjected to pressure or strain.

As used herein, the term "potting" refers to the encapsulation of electrical components with epoxy, elastomeric, silicone, or asphaltic or similar compounds for the purpose of excluding moisture or vapors. Potted components may or may not be hermetically sealed.

As used herein, the term "sealing material" refers to any material that can seal a cover of a housing to a body of a housing sufficient to withstand one or more downhole conditions including but not limited to, for example, temperature, humidity, soil composition, corrosive elements, pH, and pressure.

As used herein, the term "sensor" includes any electrical sensing device or gauge. The sensor may be capable of monitoring or detecting pressure, temperature, fluid flow, vibration, resistivity, or other formation data. Alternatively, the sensor may be a position sensor.

As used herein, the term "subsurface" refers to geologic strata occurring below the earth's surface.

As used herein, the term "topside communications node" refers to a communications node that can be located topside, proximate a surface. Alternatively, the topside communications node can be a virtual topside communications node that can be located subsurface or downhole, and can function as a topside node. The virtual topside node can be placed below surface near, for example, a pay zone or other region of sensing interest, for example, in a production zone of a vertical or horizontal section.

The topside communication node may, for example, include a subsurface "wired topside node" or a node that communicates with the surface via long-range wireless communication. For example, this implementation approach can be used where a wireline is dropped to start of deviated section, then a hydrophone, or other near-range wireless device communicates with the acoustic nodes in production zones (for example, vertical or horizontal sections or a combination thereof). Such an approach would reduce the number of nodes necessary to communicate all the way to the surface, thus, providing an economical alternative.

The terms "tubular member" or "tubular body" refer to any pipe, such as a joint of casing, a portion of a liner, a drill string, a production tubing, an injection tubing, a pup joint, a buried pipeline, underwater piping, or above-ground piping.

As used herein, the term "wellbore" refers to a hole in the subsurface made by drilling or insertion of a conduit into the subsurface. A wellbore may have a substantially circular cross section, or other cross-sectional shape. As used herein, the term "well," when referring to an opening in the formation, may be used interchangeably with the term "wellbore."

The terms "zone" or "zone of interest" refer to a portion of a subsurface formation containing hydrocarbons. The term "hydrocarbon-bearing formation" may alternatively be used.

Description

FIG. 1 is a side, cross-sectional view of an illustrative well site 100. The well site 100 includes a derrick 120 at an earth surface 101. The well site 100 also includes a wellbore 150 extending from the earth surface 101 and down into an earth subsurface 155. The wellbore 150 is being formed using the derrick 120, a drill string 160 below the derrick 120, and a bottom hole assembly 170 at a lower end of the drill string 160.

Referring first to the derrick 120, the derrick 120 includes a frame structure 121 that extends up from the earth surface 101. The derrick 120 supports drilling equipment including a traveling block 122, a crown block 123 and a swivel 124. A so-called kelly 125 is attached to the swivel 124. The kelly 125 has a longitudinally extending bore (not shown) in fluid communication with a kelly hose 126. The kelly hose 126, also known as a mud hose, is a flexible, steel-reinforced, high-pressure hose that delivers drilling fluid through the bore of the kelly 125 and down into the drill string 160.

The kelly 125 includes a drive section 127. The drive section 127 is non-circular in cross-section and conforms to an opening 128 longitudinally extending through a kelly drive bushing 129. The kelly drive bushing 129 is part of a rotary table. The rotary table is a mechanically driven device that provides clockwise (as viewed from above) rotational force to the kelly 125 and connected drill string 160 to facilitate the process of drilling a borehole 105. Both linear and rotational movement may thus be imparted from the kelly 125 to the drill string 160.

A platform 102 is provided for the derrick 120. The platform 102 extends above the earth surface 101. The platform 102 generally supports rig hands along with various components of drilling equipment such as pumps, motors, gauges, a dope bucket, tongs, pipe lifting equipment and control equipment. The platform 102 also supports the rotary table.

It is understood that the platform 102 shown in FIG. 1 is somewhat schematic. It is also understood that the platform 102 is merely illustrative and that many designs for drilling rigs and platforms, both for onshore and for offshore operations, exist. These include, for example, top drive drilling systems. The claims provided herein are not limited by the configuration and features of the drilling rig unless expressly stated in the claims.

Placed below the platform 102 and the kelly drive section 127 but above the earth surface 101 is a blow-out preventer, or BOP 130. The BOP 130 is a large, specialized valve or set of valves used to control pressures during the drilling of oil and gas wells. Specifically, blowout preventers control the fluctuating pressures emanating from subterranean formations during a drilling process. The BOP 130 may include upper 132 and lower 134 rams used to isolate flow on the back side of the drill string 160. Blowout preventers 130 also prevent the pipe joints making up the drill string 160 and the drilling fluid from being blown out of the wellbore 150 in the event of a sudden pressure kick.

As shown in FIG. 1, the wellbore 150 is being formed down into the subsurface formation 155. In addition, the wellbore 150 is being shown as a deviated wellbore. Of course, this is merely illustrative as the wellbore 150 may be a vertical well or even a horizontal well, as shown later in FIG. 2.

In drilling the wellbore 150, a first string of casing 110 is placed down from the surface 101. This is known as surface casing 110 or, in some instances (particularly offshore), conductor pipe. The surface casing 110 is secured within the formation 155 by a cement sheath 112. The cement sheath 112 resides within an annular region 115 between the surface casing 110 and the surrounding formation 155.

During the process of drilling and completing the wellbore 150, additional strings of casing (not shown) will be provided. These may include intermediate casing strings and a final production casing string. For an intermediate case string or the final production casing, a liner may be employed, that is, a string of casing that is not tied back to the surface 101.

As noted, the wellbore 150 is formed by using a bottom hole assembly 170. The bottom-hole assembly 170 allows the operator to control or "steer" the direction or orientation of the wellbore 150 as it is formed. In this instance, the bottom hole assembly 170 is known as a rotary steerable drilling system, or RSS.

The bottom hole assembly 170 will include a drill bit 172. The drill bit 172 may be turned by rotating the drill string 160 from the platform 102. Alternatively, the drill bit 172 may be turned by using so-called mud motors 174. The mud motors 174 are mechanically coupled to and turn the nearby drill bit 172. The mud motors 174 are used with stabilizers or bent subs 176 to impart an angular deviation to the drill bit 172. This, in turn, deviates the well from its previous path in the desired azimuth and inclination.

The illustrative well site 100 also includes a sensor 178. In some embodiments, the sensor 178 is part of the bottom hole assembly 170. The sensor 178 may be, for example, a set of position sensors that is part of the electronics for an RSS. Alternatively or in addition, the sensor 178 may be a temperature sensor, a pressure sensor, or other sensor for detecting a downhole condition during drilling. Alternatively still, the sensor may be an induction log or gamma ray log or other log that detects fluid and/or geology downhole.

There are several advantages to directional drilling. These primarily include the ability to complete a wellbore along a substantially horizontal axis of a subsurface formation, thereby exposing a greater formation face. These also include the ability to penetrate into subsurface formations that are not located directly below the wellhead. This is particularly beneficial where an oil reservoir is located under an urban area or under a large body of water. Another benefit of directional drilling is the ability to group multiple wellheads on a single platform, such as for offshore drilling. Finally, directional drilling enables multiple laterals and/or sidetracks to be drilled from a single wellbore in order to maximize reservoir exposure and recovery of hydrocarbons.

As the wellbore 150 is being formed, the operator may wish to evaluate the integrity of the cement sheath 112 placed around the surface casing 110 (or other casing string). To do this, the industry has relied upon so-called cement bond logs. A cement bond log (or CBL), uses an acoustic signal that is transmitted by a logging tool at the end of a wireline. The logging tool includes a transmitter, and one or more receivers that "listen" for sound waves generated by the transmitter through the surrounding casing string. The logging tool includes a signal processor that takes a continuous measurement of the amplitude of sound pulses from the transmitter to the receiver. Alternately, the attenuation of the sonic signal may be measured.

In some instances, a bond log will measure acoustic impedance of the material in the annulus directly behind the casing. This may be done through resonant frequency decay. Such logs include, for example, the USIT log of Schlumberger (of Sugar Land, Tex.) and the CAST-V log of Halliburton (of Houston, Tex.).

It is desirable to implement a downhole telemetry system that enables the operator to evaluate cement sheath integrity without need of running a CBL line. This enables the operator to check cement sheath integrity as soon as the cement has set in the annular region 115 or as soon as the wellbore 150 is completed. To do this, the well site 100 includes a plurality of communications nodes 180, 182. The communications nodes 180, 182 are placed along the outer surface of the surface casing 110 according to a pre-designated spacing. The communications nodes then send acoustic signals up the wellbore 150 in node-to-node arrangement.

The nodes first include a topside communications node 182. The topside communications node 182 can be placed closest to the surface 101. The topside communications node 182 is configured to receive acoustic signals and convert them to acoustic, electrical or optical signals. The topside communications node 182 may be above grade or below grade.

In addition, the nodes include a plurality of subsurface communications nodes 180. The subsurface communications nodes 180 are configured to receive and then relay acoustic signals along the length of the wellbore 150 up to the topside communications node 182.

The well site 100 of FIG. 1 also shows a transmitter/receiver 190. The transmitter/receiver 190 comprises a processor 192 that receives signals sent from the topside communications node 182 or transmits to the topside node 182. The signals may be sent through a wire (not shown) such as a co-axial cable, a fiber optic cable, a USB cable, or other electrical or optical communications wire. Alternatively, the transmitter/receiver 190 may transmit/receive the final signals to/from the topside node 182 wirelessly through a modem, a transceiver or other wireless communications link such as Bluetooth or Wi-Fi. The transmitter/receiver 190 may also receive electrical signals via a so-called Class I, Division I conduit, that is, a housing for wiring that is considered acceptably safe in an explosive environment. In some applications, radio, infrared or microwave signals may be utilized. The transmitter/receiver 190 can communicate with the topside node using acoustic signals sent through the wellbore structures.

The processor 192 may include discrete logic, any of various integrated circuit logic types, or a microprocessor. In any event, the processor 192 may be incorporated into a computer having a screen. The computer may have a separate keyboard 194, as is typical for a desk-top computer, or an integral keyboard as is typical for a laptop or a personal digital assistant. In one aspect, the processor 192 is part of a multi-purpose "smart phone" having specific "apps" and wireless connectivity.

FIG. 1 illustrates the use of a wireless data telemetry system during a drilling operation. However, the wireless downhole telemetry system may also be employed after a well is completed. This enables the operator to confirm the viability of a cement sheath after, for example, formation fracturing operations have taken place.

FIG. 2 is a cross-sectional view of an illustrative well site 200. The well site 200 includes a wellbore 250 that penetrates into a subsurface formation 255. The wellbore 250 has been completed as a cased-hole completion for producing hydrocarbon fluids. The well site 200 also includes a well head 260. The well head 260 is positioned at an earth surface 201 to control and direct the flow of formation fluids from the subsurface formation 255 to the surface 201.

Referring first to the well head 260, the well head 260 may be any arrangement of pipes or valves that receive reservoir fluids at the top of the well. In the arrangement of FIG. 2, the well head 260 represents a so-called Christmas tree. A Christmas tree is typically used when the subsurface formation 255 has enough in situ pressure to drive production fluids from the formation 255, up the wellbore 250, and to the surface 201. The illustrative well head 260 includes a top valve 262 and a bottom valve 264.

It is understood that rather than using a Christmas tree, the well head 260 may alternatively include a motor (or prime mover) at the surface 201 that drives a pump. The pump, in turn, reciprocates a set of sucker rods and a connected positive displacement pump (not shown) downhole. The pump may be, for example, a rocking beam unit or a hydraulic piston pumping unit. Alternatively still, the well head 260 may be configured to support a string of production tubing having a downhole electric submersible pump, a gas lift valve, or other means of artificial lift (not shown). The present inventions are not limited by the configuration of operating equipment at the surface unless expressly noted in the claims.

Referring next to the wellbore 250, the wellbore 250 has been completed with a series of pipe strings referred to as casing. First, a string of surface casing 210 has been cemented into the formation. Cement is shown in an annular bore 215 of the wellbore 250 around the casing 210. The cement is in the form of an annular sheath 212. The surface casing 210 has an upper end in sealed connection with the lower valve 264.

Next, at least one intermediate string of casing 220 is cemented into the wellbore 250. The intermediate string of casing 220 is in sealed fluid communication with the upper master valve 262. A cement sheath 212 is again shown in a bore 215 of the wellbore 250. The combination of the casing 210/220 and the cement sheath 212 in the bore 215 strengthens the wellbore 250 and facilitates the isolation of formations behind the casing 210/220.

It is understood that a wellbore 250 may, and typically will, include more than one string of intermediate casing. In some instances, an intermediate string of casing may be a liner.

Finally, a production string 230 is provided. The production string 230 is hung from the intermediate casing string 230 using a liner hanger 231. The production string 230 is a liner that is not tied back to the surface 101. In the arrangement of FIG. 2, a cement sheath 232 is provided around the liner 230.

The production liner 230 has a lower end 234 that extends to an end 254 of the wellbore 250. For this reason, the wellbore 250 is said to be completed as a cased-hole well. Those of ordinary skill in the art will understand that for production purposes, the liner 230 may be perforated after cementing to create fluid communication between a bore 235 of the liner 230 and the surrounding rock matrix making up the subsurface formation 255. In one aspect, the production string 230 is not a liner but is a casing string that extends back to the surface.

As an alternative, end 254 of the wellbore 250 may include joints of sand screen (not shown). The use of sand screens with gravel packs allows for greater fluid communication between the bore 235 of the liner 230 and the surrounding rock matrix while still providing support for the wellbore 250. In this instance, the wellbore 250 would include a slotted base pipe as part of the sand screen joints. Of course, the sand screen joints would not be cemented into place and would not include subsurface communications nodes.

The wellbore 250 optionally also includes a string of production tubing 240. The production tubing 240 extends from the well head 260 down to the subsurface formation 255. In the arrangement of FIG. 2, the production tubing 240 terminates proximate an upper end of the subsurface formation 255. A production packer 241 is provided at a lower end of the production tubing 240 to seal off an annular region 245 between the tubing 240 and the surrounding production liner 230. However, the production tubing 240 may extend closer to the end 234 of the liner 230.

In some completions a production tubing 240 is not employed. This may occur, for example, when a monobore is in place.

It is also noted that the bottom end 234 of the production string 230 is completed substantially horizontally within the subsurface formation 255. This is a common orientation for wells that are completed in so-called "tight" or "unconventional" formations. Horizontal completions not only dramatically increase exposure of the wellbore to the producing rock face, but also enables the operator to create fractures that are substantially transverse to the direction of the wellbore. Those of ordinary skill in the art may understand that a rock matrix will generally "part" in a direction that is perpendicular to the direction of least principal stress. For deeper wells, that direction is typically substantially vertical. However, the present inventions have equal utility in vertically completed wells or in multi-lateral deviated wells.

As with the well site 100 of FIG. 1, the well site 200 of FIG. 2 includes a telemetry system that utilizes a series of novel communications nodes. This again is for the purpose of evaluating the integrity of the cement sheath 212, 232, or other data telemetry. The communications nodes are placed along the outer diameter of the casing strings 210, 220, 230. These nodes allow for the high speed transmission of wireless signals based on the in situ generation of acoustic waves.

The nodes can first include a topside communications node 282. The topside communications node 282 is placed closest to the surface 201 and may be above or below grade. The topside node 282 is configured to transmit and receive acoustic signals.

In addition, the nodes include a plurality of subsurface communications nodes 280. Each of the subsurface communications nodes 280 is configured to receive and then relay acoustic signals along essentially the length of the wellbore 250. For example, the subsurface communications nodes 280 can utilize two-way electro-acoustic transducers to receive and relay mechanical waves.

The subsurface communications nodes 280 transmit signals as acoustic waves. The acoustic waves can be at a frequency of, for example, between about 50 kHz and 500 kHz. The signals are delivered up to the topside communications node 282 so that signals indicative of cement integrity are sent from node-to-node. A last subsurface communications node 280 transmits the signals acoustically to the topside communications node 282. Communication may be between adjacent nodes or may skip nodes depending on node spacing or communication range. Communication can be routed around nodes which are not functioning properly.

The well site 200 of FIG. 2 shows a transmitter/receiver 270. The transmitter/receiver 270 can comprise a processor 272 that transmits/receives signals sent to or from the topside communications node 282. The processor 272 may include discrete logic, any of various integrated circuit logic types, or a microprocessor. The receiver 270 may include a screen and a keyboard 274 (either as a keypad or as part of a touch screen). The transmitter/receiver 270 may also be an embedded controller with neither a screen nor a keyboard which communicates with a remote computer such as via wireless, cellular modem, or telephone lines.

The signals may be received by the processor 272 through a wire (not shown) such as a co-axial cable, a fiber optic cable, a USB cable, or other electrical or optical communications wire. Alternatively, the transmitter/receiver 270 may receive the final signals from the topside node 282 wirelessly through a modem or transceiver. The transmitter/receiver 270 can receive electrical signals via a so-called Class I, Div. I conduit, that is, a wiring system or circuitry that is considered acceptably safe in an explosive environment.

FIGS. 1 and 2 present illustrative wellbores 150, 250 that may receive a downhole telemetry system using acoustic transducers. In each of FIGS. 1 and 2, the top of the drawing page is intended to be toward the surface and the bottom of the drawing page toward the well bottom. While wells commonly are completed in substantially vertical orientation, it is understood that wells may also be inclined and even horizontally completed. When the descriptive terms "up" and "down" or "upper" and "lower" or similar terms are used in reference to a drawing, they are intended to indicate location on the drawing page, and not necessarily orientation in the ground, as the present inventions have utility no matter how the wellbore is orientated.

In each of FIGS. 1 and 2, the communications and topside nodes 180, 182, 280, and 282 are specially designed to withstand the same corrosive and environmental conditions (for example, high temperature, high pressure) of a wellbore 150 or 250, as the casing strings, drill string, or production tubing. To do so, it is preferred that the communications and topside nodes 180, 182, 280, and 282 include sealed steel housings for holding the electronics. In one aspect, the steel material is a corrosion resistant alloy.

FIG. 3A is a side view of an illustrative, nonexclusive example of a communications node 300 as may be used in the wireless data transmission systems of FIG. 1 or 2 (or other wellbore), in one aspect. The communications node 300 may be an intermediate communications node that is designed to provide two-way communication using a transceiver within a novel downhole housing assembly. Communications node 300 includes cover 310 and a body 320. The cover 310 includes an open cover portion and has a cover length, a cover width, and a cover height. The cover 310 also includes a first chamfered perimeter defining the open cover portion. The cover 3W includes a pair of opposing lengthwise tabs 311 each extending from a linear end of the cover 310 adjacent to the open cover portion, each of the lengthwise tabs 311 having a tab length, a tab thickness less than the height of the cover, a tab terminal end 313, and a first tab surface 314 and an opposing second tab surface 315. The lengthwise tabs may further comprise a tab terminal projection 316 extending from the first tab surface 314 at the terminal end 313. The tab configuration serves to accept a circumferential clamp to secure the housing including housing cover 310 and housing body 320 to a tubular, where the terminal projections 316 serve to maintain the security of the clamp.

Body 320 of FIG. 3A comprises a second chamfered perimeter defining an open body portion and an engagement portion 326. The body 320 is configured to receive one or more electrical components, has a body length, a body width, and a body height, the body being configured to cover and enclose the open cover portion of cover 310. The body 320 includes an under-surface 324. The second chamfered perimeter is configured to sealingly engage with the first chamfered perimeter of cover 310. The minimum requirement to ensure the housing cover and body can be sealed is to have at least one chamfered perimeter: either on the housing cover or body.

The upper-surface 322 of body 320 provides the attachment surface for transducers which require a direct transmission path to the tubular. An exemplary type of transducer includes piezo ceramic acoustic devices. The under-surface 324 of body 320 can include an engagement portion 326 projecting from the under-surface 324 and having an engagement surface 330 and an engagement length where the engagement length is less than or equal to a body length. The engagement portion can include a single, continuous engagement segment or can include two or more non-contiguous segments. For example, the engagement length of the engagement portion can be equal to or substantially equal to the body length, or can be from about 2% to about 98%, from about 5% to about 90%, from about 10% to about 80%, from about 15% to about 75%, from about 20% to about 70%, from about 25% to about 65%, from about 30% to about 60%, from about 35% to about 55%, from about 40% to about 50%, from about 2% to about 35%, from about 4% to about 30%, from about 6% to about 25%, from about 7% to about 20%, from about 8% to about 15%, about 9%, about 10%, about 11%, about 12%, about 13%, about 14%, or about 15% of the body length. The engagement length of each of two or more non-contiguous engagement segments, can be the same or different. The engagement length of the sum of any two or more non-contiguous engagement segments is less than the body length.

As shown in FIG. 3A, discontinuous engagement portion 326 includes three segments, each having an engagement surface 330. When communications node 300 is attached to an outer surface of a tubular, at least a portion of engagement surface 330 of the engagement portion 320 is in contact with the outer surface of the tubular.

Substantially the entire engagement surface 330 or a portion of the engagement surface 330 may be in contact with an outer surface of the tubular. For example, when the engagement portion comprises a radiused engagement surface, substantially the entire engagement surface may be in direct contact with the outer surface of the tubular.

The design of the tabs 311 is such that tab surfaces 315 are disposed above engagement surface 330 prior to clamping, thus defining shoulder 328 as also shown by 328' in FIG. 3B. Shoulder 328 is defined by projection of the engagement surface 330 beyond the second tab surface 315, and the shoulder provides clearance between the second tab surface 315 and the outer surface of the tubular. Tabs 311 are raised above the outer surface of a tubular prior to clamping. Upon clamping the acoustic housing to a tubular, with a clamp attached at each of tabs 311, the cover 310 pulls the engagement surfaces 330 of body 320, into secure contact with the outer surface of the tubular. Upon clamping, tab surfaces 315 of tabs 311, may or may not contact the outer surface of the tubular.

The cover 310 and the body 320 including one or more electrical components, are sealed via the second chamfered perimeter of the body 320 configured to sealingly engage with the first chamfered perimeter of cover 310 and a sealing material for sealing the cover to the body via said first chamfered perimeter and the second chamfered perimeter. The sealing material can be a chemical bonding material, for example, including but not limited to, an epoxy. The minimum requirement to ensure the housing cover and body can be sealed is to have at least one chamfered perimeter: either on the housing cover or body.

The first chamfered perimeter and the second chamfered perimeter can be of any configuration sufficient to sealingly engage. The first and second chamfered perimeters can include any configuration such that upon engagement with each other, a space traversing the perimeter is created defined by the first chamfered perimeter and the second chamfered perimeter, and upon sealing with a sealing material, the sealing material fills the space resulting in an improved seal. The minimum requirement to ensure the housing cover and body can be sealed is to have at least one chamfered perimeter: either on the housing cover or body. The presently described cover, body, and chamfered perimeters provide a significant improvement in that a full open architecture is provided that facilitates installation of the electronics and ceramic transducers shown in FIG. 3C. Conventional node designs fabricated in a tubular type housing having a bore therethrough, are more difficult to construct because access is limited to the borehole at each end of the tubular housing.

The presently described open architecture design provides secure acoustic coupling between the piezo ceramic transducer and the body. In particular, the open architecture design allows for direct and permanent clamping of the piezo stack to body 320 as described in U.S. Provisional Application Ser. No. 62/428,367, filed herewith on Nov. 30, 2016, and titled "Dual Transducer Communications Node For Downhole Acoustic Wireless Networks and Method Employing Same," incorporated herein by reference in its entirety. Although tubular housing designs have less perimeter to be sealed than the presently described acoustic housing, the chamfered perimeters of the presently described acoustic housing, for example, as shown in FIGS. 3A-C together with the described sealing material, provide an effective seal, tested at pressures as high as 15,000 psi. The presently described acoustic housing design, e.g., node design, having an increased perimeter for sealing differs from conventional designs that attempt to minimize the sealing perimeter in order to reduce leakage. However, the presently described chamfered perimeter design actually reduces leak risk by not only providing direct access to apply the sealing material but also by securing the contact region with the chamfer. Clamping the housing to the tubular using the tabs 311 on cover 310 further secure the sealing of the cover 310 to the body 320. Sealing a tubular housing would typically be accomplished with welded or threaded plugs. Welding can damage sensitive electronics. The application of thread sealant cannot be examined as sealant on the presently described open chamfers.

FIG. 3B is a side view of another illustrative, nonexclusive example of a communications node, i.e., communications node 300', where the engagement portion 326' is a continuous engagement portion. Communications node 300' includes cover 310' and a body 320'. Body 320' includes a single integral engagement portion 326' having an engagement length that is substantially equal to or equal to the body length. When communications node 300' is attached to an outer surface of a tubular, at least a portion of engagement surface 330' of the engagement portion 326' is in contact with the outer surface of the tubular. The entire engagement surface 330' or a portion of the engagement surface 330' may be in contact with an outer surface of the tubular.

The design of the tabs 311' is such that tab surfaces 315' are disposed above engagement surface 330' prior to clamping, thus defining shoulder 328'. Shoulder 328' is defined by projection of the engagement surface 330' beyond the second tab surface 315', and the shoulder provides clearance between the second tab surface 315' and the outer surface of the tubular. The clearance height of shoulder 328' is in the range of 1-15 mils, where 1 mil is 0.001 inch. Tabs 311' are raised above the outer surface of a tubular prior to clamping. Upon clamping the acoustic housing to a tubular, with a clamp attached at each tabs 311', the cover 310' pulls the engagement surface 330' of body 320', into secure contact with the outer surface of the tubular. Upon clamping, tab surfaces 315' of tabs 311' may or may not contact the outer surface of the tubular.

FIG. 3C is a perspective view of an illustrative, nonexclusive example of a communications node, i.e., communications node 400 before the cover 410 and the body 420 are sealed together using, for example a chemical bonding material, including for example, an epoxy. Communications node 400 includes cover 410 and body 420. Cover 410 includes an open cover portion 418, and has a cover length, a cover width, and a cover depth. The cover 410 also includes a first chamfered perimeter 417 defining an open cover portion 418. The cover 410 includes a pair of opposing lengthwise tabs 411 each extending from a linear end of the cover 410 adjacent to the open cover portion 418, each of the lengthwise tabs 411 having a tab length, a tab height less than the height of the cover, a tab terminal end 413, and a first tab surface 414 and an opposing second tab surface 415. The opposing second tab surface 415 can be a radiused tab surface along the tab length, where the curve can be selected to conform to a diameter of a particular tubular to which communications node 400 will be attached. In the example of housing 400 shown in FIG. 3C, the radius of surfaces 415 of the tabs 411 may or may not be the same or substantially the same as the radius of the engagement surface of the engagement portion of the body 420.

With regard to each aspect of the presently described subject matter, there is no requirement for the tab and the engagement geometries to match. That is, the second tab surface and the engagement surface may have configuration independently selected from a V-configuration and a radiused surface. The second tab surface may or may not also be a flat or substantially flat surface. The geometry of the tab surface and the engagement surface may be selected such that upon clamping to a tubular, at least a portion of the engagement surface contacts the outer surface of the tubular.

The lengthwise tabs 411 may further comprise a tab terminal projection extending from the first tab surface 414 at the terminal end 413, and optionally a recessed or through-hole portion (see FIG. 4A, 512).

Body 420 is configured to receive one or more electrical components, and has a body length, a body width, and a body height, the body 420 being configured to cover and enclose the open cover portion 418 of cover 410. The body 420 includes a second chamfered perimeter 423 defining an open body portion, and the body having an under-surface. In FIGS. 3B and 3C, the engagement portion 426 is integral with the body 420. The second chamfered 423 perimeter is configured to sealingly engage with the first chamfered perimeter 417 of cover 410. The minimum requirement to ensure the housing cover and body can be sealed is to have at least one chamfered perimeter: either on the housing cover or body.

The cover 410 and the body 420 including one or more electrical components, are sealed via the second chamfered perimeter 423 of the body 420 configured to sealingly engage with the first chamfered perimeter 417 of cover 410 and a sealing material for sealing the cover to the body via said first chamfered perimeter 417 and/or the second chamfered perimeter 423. The sealing material can be a chemical bonding material, including but not limited to, an epoxy.

Body 420 illustrated in FIG. 3C includes electrical components including, for example, battery pack 419*a*, circuit hoard 419*b*, and two (2) piezo assemblies 419*c* disposed in open body portion 425. The battery pack can include but is not limited to, two (2) 3-cell battery packs, for example, lithium battery packs. The batteries and the circuit board can be potted as one unit, and the piezos can have their own mechanical clamping and potting.

FIG. 4A is a perspective partial view of an illustrative, nonexclusive example of a communications node 500 including cover 510 and body 520. Cover 510 includes lengthwise tab 511 extending from a linear end of the cover 510, the lengthwise tab 511 having a tab length, a tab height less than the height of the cover 510, a tab terminal end 513, and a first tab surface 514 having recess 512 (the recessed portion may alternately be a through-hole), and an opposing second tab surface 515. The lengthwise tab can further include a tab terminal projection 516 extending from the first tab surface 514 at the terminal end 513. The cover 510 and the body 520 together defining shoulder 528. The clearance height of shoulder 528' is in the range of 1-15 mils, where 1 mil is 0.001 inch.

Body 520 is configured to receive one or more electrical components, and has a body length, a body width, and a body height, the body 520 being configured to cover and enclose the open cover portion (not seen in this view) of cover 510. The body 520 includes a second chamfered perimeter defining an open body portion (not shown), and the body having an under-surface 524, and an engagement portion 526, where engagement portion 526 can be integral with and project from the under-surface 524. The second chamfered perimeter of body 520 is configured to sealingly engage with the first chamfered perimeter of cover 510. The minimum requirement to ensure the housing cover and body can be sealed is to have at least one chamfered perimeter: either on the housing cover or body. The engagement portion 526 projects from the under-surface 524 of the body 520 and includes an engagement surface 530 and an engagement length. When a sealed communications node including cover 510 and body 520 is attached to an outer surface of a tubular, at least a portion of engagement surface 530 of the engagement portion 526 is in contact with the outer surface of the tubular. The entire engagement surface 530 or a portion of the engagement surface 530 may be in contact with an outer surface of the tubular.

The engagement surface 530 can be a radiused engagement surface along the engagement length, where the curve can be selected to conform to a diameter of a particular tubular to which a sealed communications node including cover 510, body 520, and electrical components, will be attached. Alternatively, engagement surface 530 can be a V-configuration engagement surface according to the presently described subject matter.

FIG. 4B is a perspective partial view of an illustrative, nonexclusive example of a cover 510 of a housing. Cover 510 includes lengthwise tab 511 extending from a linear end of the cover 510, the lengthwise tabs 511 having a tab length, a tab height less than the height of the cover, a tab terminal end 513, and a first tab surface 514 and an opposing second tab surface. The lengthwise tab further includes a tab terminal projection 516 extending from the first tab surface 514 at the terminal end 513, as well as recess 512. Recess 512 is available for the situation where the circumferential clamp that secures the housing to the tubular has protrusion to mate with the recess. Recess 512 may alternately be a through-hole in which a pin is inserted to couple through a hole in the circumferential clamp.

FIG. 4C is a partial bottom view of an illustrative, nonexclusive example of a body 520 of a housing. Body 520 has a body length, a body width, and a body height, the body 520 being configured to cover and enclose the open cover portion of cover 510. The body 520 includes an under-surface 524. The body 520 includes a second chamfered perimeter configured to sealingly engage with the first chamfered perimeter of cover 510 (not shown). The minimum requirement to ensure the housing cover and body can be sealed is to have at least one chamfered perimeter: either on the housing cover or body. The under-surface 524 of body 520 can include a continuous (see body 320 of FIG. 3B) or discontinuous engagement portion 526 projecting from the under-surface 524 and having an engagement surface 530 and an engagement length. When a sealed communications node including cover 510 and body 520 is attached to an outer surface of a tubular, at least a portion of engagement surface 530 of the engagement portion 526 is in contact with the outer surface of the tubular. The entire engagement surface 530 or a portion of the engagement surface 530 may be in contact with an outer surface of the tubular. The engagement surface 530 can be radiused engagement surface along the engagement length, where the curve can be selected to conform to a diameter of a particular tubular to which a sealed communications node including cover 510, body 520, and electrical components, will be attached. Alternatively, engagement surface 530 may be a V-configuration engagement surface formed by an obtuse angle, the V-configuration engagement surface provided along the engagement length, according to the presently described subject matter.

The cover 510 and the body 520 including one or more electrical components, are sealed via the first and/or second chamfered perimeters of the cover 510 and the body 520, where the chamfered perimeters are configured to sealingly engage, and a sealing material for sealing the cover to the body via the first chamfered perimeter and the second chamfered perimeter. The sealing material can be a chemical bonding material, including but not limited to, an epoxy. The minimum requirement to ensure the housing cover and body can be sealed is to have at least one chamfered perimeter: either on the housing cover or body.

FIG. 40 is a perspective partial bottom view of an illustrative, nonexclusive example of communications node 500 including cover 510 and body 520. Cover 510 includes lengthwise tab 511 extending from a linear end of the cover 510, the lengthwise tabs 511 having a tab length, a tab thickness less than the height of the body, a tab terminal end 513, and a first tab surface 514 and an opposing second tab surface 515. The lengthwise tab further includes a tab terminal projection 516 extending from the first tab surface 514 at the terminal end 513. The cover 510 and the body 520 together defining shoulder 528. The clearance height of shoulder 528' is in the range of 1-15 mils, where 1 mil is 0.001 inch. The design of the tabs 511 can be as described herein with reference to any configuration described herein.

Body 520 has a body length, a body width, and a body height, the body 520 being configured to cover and enclose the open cover portion of cover MO. The body 520 includes under-surface 524 and an engagement portion 526 extending from the under-surface 524 of the body 520. The undersurface 524 and the engagement portion 526 of body 520, can be integral, for example, produced from a single piece of material, including for example, steel. The body 520 can comprise a second chamfered perimeter configured to sealingly engage with the first chamfered perimeter of cover 510. The minimum requirement to ensure the housing cover and body can be sealed is to have at least one chamfered perimeter: either on the housing cover or body. The body 520 can include engagement portion 526 projecting from under-surface 524 and having an engagement surface 530 and an engagement length. When sealed communications node 500 is attached to an outer surface of a tubular, at least a portion of engagement surface 530 of the engagement portion 526 is in contact with the outer surface of the tubular. The opposing second tab surface 515 may or may not be in contact with the outer surface of the tubular. The entire engagement surface 530 or a portion of the engagement surface 530 may be in contact with an outer surface of the tubular. The engagement surface 530 is radiused along the engagement length, where the curve can be selected to conform to a diameter of a particular tubular to which a sealed communications node including cover 510, body 520, and electrical components, will be attached.

According to the presently described subject matter, an engagement surface and/or opposing second tab surface may be independently selected from a flat or substantially flat surface, a radiused surface or a V-configuration surface formed by an obtuse angle, for example, provided along the engagement length and/or the tab length. An engagement surface may be independently selected from a radiused engagement surface or a V-configuration engagement surface formed by an obtuse angle, for example, provided along the engagement length.

FIG. 5A is a side view of cover 610 including an open cover portion 618 configured to receive electrical components, and having a cover length, a cover width, and a cover height. The cover 610 may also include a first chamfered perimeter 617 defining an open top portion 618. The cover 610 may include a pair of opposing lengthwise tabs 611 each extending from a linear end of the cover 610 adjacent the open top portion 618, each of the lengthwise tabs 611 having a tab length, a tab thickness less than the height of the cover, a tab terminal end 613, and a first tab surface 614 and an opposing second tab surface 615. The lengthwise tabs may further comprise a tab terminal projection 616 extending from the first tab surface 614 at the terminal end and a recessed portion 612. Recess 612 may alternately be a through-hole.

FIG. 5B is a bottom view of cover 610 including a first chamfered perimeter 617 defining an open cover portion 618, and having a cover length, a cover width, and a cover height. The cover 610 may include a pair of opposing lengthwise tabs 611 each extending from a linear end of the cover 610 adjacent the open cover portion 618, each of the lengthwise tabs 611 having a tab length, a tab thickness less than the height of the cover, a tab terminal end 613, and a first tab surface and an opposing second tab surface 615. The lengthwise tabs may further comprise a tab terminal projection extending from the first tab surface at the terminal end 613, and a recessed portion 612. Recess 612 may alternately be a through-hole.

In FIGS. 5A and 5B, the opposing second tab surface 615 comprises a V-configuration tab surface formed by an obtuse angle, the V-configuration tab surface provided along the tab length. The obtuse angle can be selected in accordance with an obtuse angle of a V-configuration engagement surface of an integral engagement portion of a cover 620 in order to accommodate a particular range of tubular diameters. Suitable obtuse angles are described herein.

FIG. 5C is a top down view of body 620 that has a body length, a body width, and a body height, the body being configured to cover and enclose the open top portion 618 of cover 610. The body 620 includes a second chamfered perimeter 623 configured to sealingly engage with the first chamfered perimeter 617 of cover 610, the second chamfered perimeter 623 defining an open body portion 625. The minimum requirement to ensure the housing cover and body can be sealed is to have at least one chamfered perimeter: either on the housing cover or body. Body 620 can include a single continuous engagement portion 626 (FIG. 5D) having an engagement length that is equal to or substantially equal to the body length, an engagement height, and an engagement surface configured to engage an outer surface of a tubular. The engagement surface can include a V-configuration engagement surface formed by an obtuse angle, the V-configuration engagement surface provided along the engagement length and the obtuse angle is selected to accommodate a desired range of tubular diameters. Suitable obtuse angles are described herein.

FIG. 5D is a side view of body 620 including second chamfered perimeter 623, a continuous engagement portion 626 having an engagement length that is equal to or substantially equal to the body length, an engagement height, and a V-configuration engagement surface formed by an obtuse angle. The V-configuration engagement surface provided along the engagement length. The obtuse angle is selected to accommodate a particular desired range of tubular diameters. Suitable obtuse angles are described herein. At least a portion of the engagement surface 630 may be in direct contact with an outer surface of the tubular.

FIG. 5E is a cross-section view of housing 500 including cover 610 and body 620 that can be sealed with a sealing material provided in perimeter space 650. The cover includes open cover portion 618 and chamfered perimeter 617 (FIG. 5F) including angled edge 617*a*. The body 620 includes a V-configuration engagement surface 630 formed by an obtuse angle 630*a* (see also angle 630*b* which can be from about 1° to about 15°, from about 2° to about 12°, from about 3° to about 10°, from about 4° to about 8°, from about 5° to about 7°, about 5°, about 6°, or about 7°), the V-configuration surface provided along the engagement length. The dotted lines in FIG. 5E are indicative of the angle range for the V-configuration.

The body 620 includes chamfered perimeter 623 that may include body edges, for example, body edges 623*a* and 623*b*, sufficient to create a space upon engagement with a first perimeter 617 of a cover portion 610. The minimum requirement to ensure the housing cover and body can be sealed is to have at least one chamfered perimeter: either on the housing cover or body. Chamfered perimeter 617*a* and edges 623(*a/b*) are configured such that upon engagement, a space 650 is created and defined by chamfered edges of the chamfered perimeters 617*a* and 623(*a/b*), where upon sealing with a sealing material, the sealing material fills the space 650 resulting in an improved seal. For exemplary purposes only, upon engaging body 620 with cover 610 via the first and second chamfered perimeters, 617*a* and 623(*a/b*), respectively, a space is created between angled cover edge 617*a* of cover 610 and body edges 623*a* and 623*b* of body 620 such that the space 650 created is defined by edges 617*a*, 623*a*, and 623*b*, where upon sealing with a sealing material, the sealing material fills the space 650 resulting in an improved seal.

FIG. 5F is a cross-section view of cover 610, including cover 610, open cover portion 618, and first chamfered perimeter 617 including angled edge 617*a*.

FIG. 5G is the same view of body 620 as shown in FIG. 5E, where FIG. 5G is shown with optional malleable wire 632 having a diameter selected to bridge a gap or a portion of a gap between the engagement surface 630 and an outer surface of a tubular when a communication node having a V-configuration engagement surface 630 is attached to a tubular.

EXAMPLES

Example 1: Comparison of Engagemeynt Surfaces

Conventional designs for the node engagement surfaces would attempt to maximize the surface contact between the node and the tubular. Acoustic energy transfer from the node to the tubular should be improved by maximizing the engagement surface area. With that design approach, node engagement surfaces would be radiused to match the tubular radius.

According to the presently described subject matter, it has been found, contrary to conventional design, that the described V-configuration engagement surface provides superior acoustic energy transfer from node to tubular, where the node can be used with tubulars of varying diameter regardless of any surface imperfections present on the tubular, without sacrificing superior acoustic energy transfer.

Tubular radii have a manufacturing tolerance. Moreover, tubulars can be, for example, 40 feet long and may have some associated bending. These manufacturing tolerances, bending, and other surface imperfections may cause a radiused node to only make a linear contact with the tubular.

By analyzing the sound speed of the signals generated by the node on the tubular, it has become apparent that both shear and plane wave components are being transmitted. Shear waves are more readily launched by introducing an angular wedge between the piezo and the tubular. The V-configuration line engagement surface geometry emulates a wedged surface used in angle beam ultrasonics.

In contrast to the radiused engagement design, the V-configuration engagement surface can be applied to several different pipe diameters.

The efficacy of various V-configuration engagement surfaces and radiused engagement surfaces were evaluated and the test data is shown below. All of the test data that follow in FIGS. 6-9 were obtained with the same transmitting and receiving piezo devices. The piezo devices were moved to the different node housing pairs. Lubricating oil was used as couplant to attach the piezo stacks to the housings. In this way, any effect of the piezo efficiency was minimized.

The testing was conducted using three node housing pairs similar to the one shown in FIGS. 3A-3C. Two of the pairs have and the segmented engagement surfaces shown in FIG. 3A wherein the total engagement length is approximately 25% the body length. One of those two pairs has an engagement surface that is radiused for a 9⅝ inch diameter tubular and the other pair employs a V-configuration engagement surface. The third pair of node housings have V-configuration engagement surfaces that traverse the full length of the housing body.

As shown in FIG. 3C, each node housing was configured to accept a pair of piezo transducers, one each for transmission and one each for reception. An example of the testing layout is shown in FIG. 6. The piezo transducers are more fully described in a U.S. Provisional Application Ser. No. 62/428,367, filed herewith on Nov. 30, 2016, and titled "Dual Transducer Communications Node For Downhole Acoustic Wireless Networks and Method Employing Same," incorporated herein by reference in its entirety. For the purposes of evaluating the engagement surfaces, each housing in the node housing pair was fitted with a single piezo stack: one housing had a piezo stack for transmission and one housing had a piezo stack for reception. The housings with installed piezo stacks were attached to a tubular 700 at a specified separation distance D. A transmission was made from the housing 710 with the transmitting piezo stack 720 driven by a function generator 760 at select frequencies. This transmission was received at the housing 730 with the receiving piezo stack 740. The reception amplitude was measured as a function of the known transmit frequency with an oscilloscope 750. That process was repeated for each engagement surface tested so that the frequency response amplitudes at the receiving piezo stack could be compared.

FIGS. 7-8 show the frequency response as measured at the receiving node housing comparing full and partial V-configuration engagement surfaces. The results present the measure output voltage of the receiving piezo stack on a per unit volt of excitation at the transmit piezo stack. For these examples, the pair of housings under test was mounted on a water-filled 5½ inch tubular casing. In FIG. 7, the full V-configuration engagement surface result was compared with the partial V-configuration engagement surface. Within expected reproducibility, the two responses are comparable. In FIG. 8, the full V-configuration engagement surface was compared with the partial radius engagement surface. For this example, the full V-configuration engagement surface was clearly superior (more output at the receiver) than the partial radius engagement surface.

FIGS. 9-10 show the frequency response as measured at the receiving node housing where both housings were mounted on a 9⅝ inch air-filled casing. In FIG. 9, the full V-configuration engagement surface result is compared with the partial V-configuration engagement surface. The full V-configuration engagement surface is clearly superior (more output at the receiver) than the partial V-configuration engagement surface. In FIG. 10, the full V-configuration engagement surface was compared with the partial radius engagement surface. Within expected reproducibility, the two responses were comparable.

All of the test results shown in FIGS. 7-10 were obtained using a single pair of transducers. Moreover, the same nodes with full and partial V-configuration engagement surfaces were used. The housings with radiused V-configuration engagement surfaces were radiused to match the tubular. The transducer separation distance indicated in FIG. 6 for all of these examples, is 45 inches.

The data in FIG. 11 provide a direct comparison of identical engagement lengths to compare radiused and V-configuration type geometries. These data were obtained on a 9⅝ air-filled tubular with a transmit to receive separation distance of 40 feet. The node housings are 4 inches in length: only sufficient for the piezo stacks. Similar to the data in FIGS. 7-11, the same piezo stacks have been used to collect both sets of the data in FIG. 11. Unlike FIGS. 7-11, the results in FIG. 11 present the actual measured voltage. The identical transmit voltage excitation was applied for both measurements. Within expected reproducibility, the two responses were comparable.

The data in FIG. 12 were measured using the full-sized node housings on the same tubular at the same separation distance as was employed for the FIG. 11 assessment. Also, the same piezo stacks were used for the FIG. 12 and FIG. 11 data. The V-configuration and radiused engagement surface length were the same for both housings. The radiused engagement surface uses the same partial segmented arrangement that was employed for the FIGS. 8 and 10. Within expected reproducibility, the two responses were comparable.

Illustrative Example of a Method of Transmitting Data

A method of transmitting data in a wellbore can include the use of a plurality of communications nodes situated along a tubular body to accomplish a wireless transmission of data along the wellbore. The wellbore penetrates into a subsurface formation, allowing for the communication of a wellbore condition at the level of the subsurface formation up to the surface.

The method first includes running a tubular body into the wellbore. The tubular body is formed by connecting a series of pipe joints end-to-end. The pipe joints are fabricated from a steel material that is suitable for conducting an acoustical signal.

The method also includes placing at least one sensor along the wellbore at a depth of the subsurface formation. Here, the sensor may be a pressure sensor, a temperature sensor, an inclinometer, a logging tool, a resistivity sensor, a vibration sensor, a fluid density sensor, a fluid identification sensor, a fluid flow measurement device (such as a so-called "spinner") or other sensor. The sensor may reside, for example, along a string of drill pipe as part of a rotary steerable drilling system. Alternatively, the sensor may reside along a string of casing within a well bore. Alternatively still, the sensor may reside along a string of production tubing or a joint of sand screen.

The method further includes attaching a sensor communications node to the tubular body. The sensor communications node may be placed outside of a tubular body. The sensor communications node is then placed at the depth of the subsurface formation. The sensor communications node is in communication with the at least one sensor. This is preferably a short wired connection or a connection through a circuit board. Alternatively, the communication could be acoustic or radio frequency (RF), particularly in the case when the sensor and communications nodes are not in the same housing. The sensor communications node is configured to receive signals from the at least one sensor. The signals represent a subsurface condition such as temperature, pressure, pipe strain, fluid flow or fluid composition, or geology.

The at least one sensor can reside within the housing for the sensor communications node. The sensor communications node may alternatively be configured to use the electro-acoustic transducer as a sensor.

The method also provides for attaching a topside communications node to the tubular body. The topside communications node is attached to the tubular body proximate the surface or subsurface. In one aspect, the topside communications node is connected to the well head, which for purposes of the present disclosure may be considered part of the tubular body.

The method further comprises attaching a plurality of intermediate communications nodes to the tubular body. The intermediate communications nodes reside in spaced-apart relation along the tubular body between the sensor communications node and the topside communications node. The intermediate communications nodes are configured to receive and transmit acoustic waves from the sensor communications node, up and/or down the well, for example, to the topside node. In one aspect, piezo wafers or other piezoelectric elements are used to receive and transmit acoustic signals. In another aspect, multiple stacks of piezoelectric crystals or magnetostrictive devices are used. Signals are created by applying electrical signals of an appropriate frequency across one or more piezoelectric crystals, causing them to vibrate at a rate corresponding to the frequency of the desired acoustic signal. Each acoustic signal represents a packet of data comprised of a collection of separate tones.

In the method each of the intermediate communications nodes has an independent power source. The independent power source may be, for example, batteries or a fuel cell. In addition, each of the intermediate communications nodes has a transducer. The transducer is preferably an electro-acoustic transducer with an associated transceiver that is designed to receive the acoustic waves and produce acoustic waves.

In one aspect, the data transmitted between the nodes is represented by acoustic waves according to a multiple frequency shift keying (MFSK) modulation method. Although MFSK is well-suited for this application, its use as an example is not intended to be limiting. It is known that various alternative forms of digital data modulation are available, for example, frequency shift keying (FSK), multi-frequency signaling (MF), phase shift keying (PSK), pulse position modulation (PPM), and on-off keying (OOK). In one embodiment, every 4 bits of data are represented by selecting one out of sixteen possible tones for broadcast.

Acoustic telemetry along tubulars is characterized by multi-path or reverberation which persists for a period of milliseconds. As a result, a transmitted tone of a few milliseconds duration determines the dominant received frequency for a time period of additional milliseconds. The communication nodes determine the transmitted frequency by receiving or "listening to" the acoustic waves for a time period corresponding to the reverberation time, which is typically much longer than the transmission time. The tone duration should be long enough that the frequency spectrum of the tone burst has negligible energy at the frequencies of neighboring tones, and the listening time must be long enough for the multipath to become substantially reduced in amplitude. In one aspect, the tone duration is 2 ms, then the transmitter remains silent for 48 milliseconds before sending the next tone. The receiver, however, listens for 2+48=50 ms to determine each transmitted frequency, utilizing the long reverberation time to make the frequency determination more certain. Beneficially, the energy required to transmit data is reduced by transmitting for a short period of time and exploiting the multi-path to extend the listening time during which the transmitted frequency may be detected.

In one embodiment, an MFSK modulation is employed where each tone is selected from an alphabet of 16 tones, so that it represents 4 bits of information. With a listening time of 50 ms, for example, the data rate is 80 bits per second.

The tones are selected to be within a frequency band where the signal is detectable above ambient and electronic noise at least two nodes away from the transmitter node so that if one node fails, it can be bypassed by transmitting data directly between its nearest neighbors above and below. In one example, the tones can be approximately evenly spaced in frequency, but the tones may be spaced within a frequency band from about 50 kHz to about 500 kHz. More preferably, the tones are evenly spaced in a period within a frequency band approximately 25 kHz wide centered around or including 100 kHz.

The nodes can employ a "frequency hopping" method where the last transmitted tone is not immediately re-used. This prevents extended reverberation from being mistaken for a second transmitted tone at the same frequency. For example, 17 tones are utilized for representing data in an MFSK modulation scheme; however, the last-used tone is excluded so that only 16 tones are actually available for selection at any time.

In one aspect, the tubular body is a drill string. In this instance, each of the intermediate communications nodes can be placed along an outer diameter of pipe joints making up the drill string. In another aspect, the tubular body is a casing string. In this instance, each of the intermediate communications nodes is placed along an outer surface of pipe joints making up the casing string. In another aspect, the tubular body is a production string such as tubing. In this instance, each of the intermediate communications nodes may be placed along an outer diameter of pipe joints making up the production string.

In one aspect, the method further includes transmitting a signal from the topside communications node to a receiver. The topside communications node can also comprises an independent power source, meaning that it does not also supply power to any other intermediate or sensor communications node. The independent power source may be either internal to or external to the topside communications node. Further, the topside communications node can include an electro-acoustic transducer designed to receive the acoustic waves from one or more of the plurality of intermediate communications nodes, and transmit acoustic waves to the receiver as a new signal. The topside communications node can include a magnetically activated reed switch or other means to silence radio transmissions from the node without opening the Class I Div I housing.

The communication signal between the topside communications node and the receiver may be either a wired electrical signal or a wireless radio transmission. Alternatively, the signal may be an optical signal. In any instance, the signal represents a subsurface condition as transmitted by the sensor in the subsurface formation. The signals are received by the receiver, which has data acquisition capabilities. The receiver may employ either volatile or non-volatile memory. The data may then be analyzed at the surface.

INDUSTRIAL APPLICABILITY

The apparatus and methods disclosed herein are applicable to the oil and gas industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed is:

1. An acoustic housing, comprising:

a cover comprising a first perimeter defining an open cover portion, and having a cover length and a cover height; and a body comprising:

a second perimeter defining an open body portion configured to receive one or more electrical components and to sealingly engage with the first perimeter, the body having a body length, a body height, and an under-surface, at least one of the first perimeter and the second perimeter comprising a first chamfered perimeter and a second chamfered perimeter, respectively; and an engagement portion projecting from the under-surface and having an engagement length, an engagement height, and an engagement surface configured to engage an outer surface of a tubular.

2. The acoustic housing of claim 1, wherein the body includes a second chamfered perimeter and is configured to sealingly engage with an unchamfered perimeter of the cover.

3. The acoustic housing of claim 1, wherein the cover includes first chamfered perimeter that is configured to sealingly engage with an unchamfered perimeter of the body.

4. The acoustic housing of claim 1, wherein the body and the engagement portion are integral.

5. The acoustic housing of claim 1, wherein the engagement portion is a continuous engagement portion.

6. The acoustic housing of claim 5, wherein the continuous engagement portion comprises a single continuous engagement portion having an engagement length that is substantially equal to or less than the body length.

7. The acoustic housing of claim 1, wherein the engagement portion is a discontinuous engagement portion.

8. The acoustic housing of claim 7, wherein the discontinuous engagement portion comprises at least two non-contiguous segments.

9. The acoustic housing of claim 8, wherein the body and the engagement portion are integral.

10. The acoustic housing of claim 1, wherein the body and the engagement portion are integral.

11. The acoustic housing of claim 1, wherein the engagement portion comprises a V-configuration engagement surface comprising an obtuse angle, defining a lengthwise central groove traversing the engagement length.

12. The acoustic housing of claim 11, wherein the engagement portion has a V-shaped cross-section.

13. The acoustic housing of claim 11, wherein the V-configuration comprises an obtuse angle >90□ and <180□.

14. The acoustic housing of claim 11, wherein the obtuse angle is an angle of from 100° to 175°.

15. The acoustic housing of claim 11, further comprising a malleable sealant material provided in the central groove.

16. The acoustic housing of claim 15, wherein the malleable sealant material is configured to bridge at least a portion of a gap between the V-configuration engagement surface and the outer surface of the tubular when the acoustic housing is attached to the outer surface of the tubular.

17. The acoustic housing of claim 15, wherein the diameter is sufficient to bridge the gap.

18. The acoustic housing of claim 1, wherein the engagement surface comprises a radiused engagement surface.

19. The acoustic housing of claim 1, wherein the first perimeter includes a first chamfered perimeter and the second perimeter includes a second chamfered perimeter and the first chamfered perimeter and the second chamfered perimeter are configured such that upon engagement with each other, a perimeter space is defined therebetween the first chamfered perimeter and the second chamfered perimeter.

20. The acoustic housing of claim 1, further comprising one or more electrical components disposed in the open body portion.

21. The acoustic housing of claim 20, wherein the one or more electrical components comprise an independent power source, an electro-acoustic transducer, and a transceiver for at least one of receiving acoustic waves and transmitting acoustic waves.

22. The acoustic housing of claim 21, further comprising a sealant material provided in engagement with at least one of the first chamfered perimeter and the second chamfered perimeter to at least one of further seal the cover and the body together and adhesively secure the cover and the body together.

23. The acoustic housing of claim 22, wherein the malleable sealant material comprises at least one of metal wire and a metal alloy wire having a diameter.

24. The acoustic housing of claim 23, further comprising a shoulder defined by projection of the engagement surface beyond the second tab surface, and the shoulder provides clearance between the second tab surface and the outer surface of the tubular.

25. The acoustic housing of claim 24, where in the shoulder provides a clearance in the range of from 0.5 mils and 15 mils, inclusively, when the cover is assembled with the body.

26. The acoustic housing of claim 23, wherein each of the first lengthwise tab and the second lengthwise tab further comprise a terminal projection extending from the first tab surface at the terminal end.

27. The acoustic housing of claim 23, wherein the second tab surface comprises a V-configuration tab surface provided along the tab length.

28. The acoustic housing of claim 23, wherein the second tab surface comprises a radiused tab surface provided along the tab length.

29. The acoustic housing of claim 23, further comprising at least one clamp for attaching the acoustic housing to an outer surface of a tubular.

30. The acoustic housing of claim 29, wherein the at least one clamp comprises a first arcuate section; a second arcuate section; a hinge for pivotally connecting the first and second arcuate sections; and a fastening mechanism for securing the first and second arcuate sections around an outer surface of a tubular.

31. The acoustic housing of claim 30, wherein the clamp is provided over the first tab surface between the terminal projection and a linear end of the body such that when the acoustic housing is attached to the outer wall of a tubular, the tab is disposed between an inner surface of the clamp and the outer surface of the tubular.

32. The acoustic housing of claim 1, further comprising a first lengthwise tab extending from a first linear end of the cover adjacent the open cover portion, and a second lengthwise tab extending from an opposing second linear end of the cover adjacent the open cover portion, each of the first and second lengthwise tabs having a tab length, a tab height less than the cover height, a terminal end, and a first tab surface and an opposing second tab surface.

* * * * *